US011350710B2

(12) United States Patent
Bennett et al.

(10) Patent No.: US 11,350,710 B2
(45) Date of Patent: Jun. 7, 2022

(54) ORNAMENT FOR BEING STRUNG ON AN ELONGATED MEMBER

(71) Applicant: PANDORA A/S, København V (DK)

(72) Inventors: Patrick Scott Bennett, Bangkok (TH); Jean-Pierre Phouthapanya Selbe, Bangkok (TH); Kasem Repia, Bangkok (TH)

(73) Assignee: Pandora A/S, København V (DK)

( * ) Notice: Subject to any disclaimer, the term of this patent is extended or adjusted under 35 U.S.C. 154(b) by 0 days.

(21) Appl. No.: 16/603,479

(22) PCT Filed: Apr. 6, 2018

(86) PCT No.: PCT/DK2018/050066
§ 371 (c)(1),
(2) Date: Oct. 7, 2019

(87) PCT Pub. No.: WO2018/184647
PCT Pub. Date: Oct. 11, 2018

(65) Prior Publication Data

US 2020/0383437 A1 Dec. 10, 2020

(30) Foreign Application Priority Data

Apr. 7, 2017 (DK) ..... PA201770251

(51) Int. Cl.
*A44C 25/00* (2006.01)
*A44C 5/00* (2006.01)
*A44C 15/00* (2006.01)

(52) U.S. Cl.
CPC ..... *A44C 25/007* (2013.01); *A44C 5/00* (2013.01); *A44C 15/005* (2013.01)

(58) Field of Classification Search
CPC ..... A44C 25/00; A44C 25/001; A44C 25/007; A44C 9/0038; A44C 11/002; A44C 11/005
See application file for complete search history.

(56) References Cited

U.S. PATENT DOCUMENTS 2,763,999 A * 9/1956 Norman ..... A44C 7/004 63/14.3
3,129,970 A * 4/1964 St John ..... H01J 9/006 81/53.11

(Continued)

FOREIGN PATENT DOCUMENTS

EP 2764792 A1 * 8/2014 ..... A44C 11/002
EP 2764792 A1 8/2014

(Continued)

OTHER PUBLICATIONS

Danish Application No. PA201770251, Search Report dated Sep. 26, 2017, 4 pages.

(Continued)

*Primary Examiner* — Emily M Morgan
(74) *Attorney, Agent, or Firm* — Avek IP, LLC

(57) ABSTRACT

An ornament for being strung on an elongated member includes a shell having a cavity and a first friction element. The ornament may be arranged in an un-assembled configuration, in which the first friction element is un-attached to the shell, and an assembled configuration, in which the first friction element is attached to the shell. The first friction element has a first retaining part, arranged in the cavity when the ornament is in the assembled configuration, and a first friction part attached to the first retaining part and comprising a first gripping surface for frictionally gripping a surface of the elongated member. The ornament, in the assembled configuration, is strung on the elongated member, and is releasably secured in a first location on the elongated (Continued)

member. The first friction part and the first retaining part have different material and/or mechanical properties in the unassembled configuration.

17 Claims, 11 Drawing Sheets

(56) References Cited

U.S. PATENT DOCUMENTS

| | | | | |
|---|---|---|---|---|
| 6,263,703 | B1 * | 7/2001 | Kenney | A44C 7/004 24/507 |
| 6,460,231 | B2 * | 10/2002 | Bourgerie | A01K 97/08 24/487 |
| 9,451,813 | B1 * | 9/2016 | Cipolla | A44C 27/001 |
| 10,702,026 | B2 * | 7/2020 | Gray | A44C 1/00 |
| 2003/0154742 | A1 * | 8/2003 | Ooide | A44C 5/2071 63/38 |
| 2004/0144131 | A1 * | 7/2004 | Enevoldsen | A44C 15/005 63/3 |
| 2006/0260300 | A1 * | 11/2006 | Julkowski | A44C 11/002 60/300 |
| 2009/0162816 | A1 * | 6/2009 | Charles | G09B 19/0092 434/127 |
| 2012/0234045 | A1 * | 9/2012 | Heiden | A44C 5/208 63/23 |
| 2014/0182332 | A1 * | 7/2014 | Gray | A44C 5/20 63/3.1 |
| 2014/0223962 | A1 * | 8/2014 | Gray | A44C 27/00 63/3 |
| 2016/0213508 | A1 * | 7/2016 | Sherman | B65B 7/2821 |
| 2018/0213892 | A1 * | 8/2018 | Gray | A44B 13/02 |
| 2018/0213893 | A1 * | 8/2018 | Gray | A44C 1/00 |
| 2020/0046088 | A1 * | 2/2020 | Dadlani | A44C 5/2042 |

FOREIGN PATENT DOCUMENTS

| | | | | |
|---|---|---|---|---|
| KR | 101613447 | B1 | 6/2014 | |
| WO | 2005/009166 | A2 | 7/2004 | |
| WO | 2014/121797 | A1 | 2/2014 | |
| WO | 2014/121798 | A1 | 2/2014 | |
| WO | 2016034182 | A1 | 9/2015 | |
| WO | 2017/013066 | A1 | 7/2016 | |
| WO | 2017/013067 | A1 | 7/2016 | |
| WO | WO2017013066 | * | 1/2017 | A44C 25/00 |
| WO | WO2017013067 | * | 1/2017 | A44C 25/00 |
| WO | WO-2018184647 | A1 * | 10/2018 | A44C 15/005 |

OTHER PUBLICATIONS

PCT/DK2018/050066, International Search Report, dated Jun. 18, 2018, 19 pages.

* cited by examiner

ORNAMENT FOR BEING STRUNG ON AN ELONGATED MEMBER

CROSS-REFERENCE TO RELATED APPLICATIONS

This application is a national phase of, and claims priority to, International Application No. PCT/DK2018/050066, filed Apr. 6, 2018, which designated the U.S. and which claims priority to Danish Patent Application No. PA 2017 70251, filed Apr. 7, 2017. Each of these applications are incorporated herein by reference in their entireties.

FIELD OF THE INVENTION

The disclosure relates to jewelry ornaments for being strung on an elongated member, such as a chain, string or bangle, of a bracelet or necklace; to jewelry systems comprising such an ornament; to methods of manufacture of such ornaments; and to methods for assembly of such ornaments.

BACKGROUND

In this disclosure, "jewelry ornament" may also be denoted "ornament" or "ornamental component".

Many prior art jewelry systems, such as bracelets and necklaces, comprise a plurality of freely moveable ornamental components, e.g. beads or charms, strung on an elongated member, e.g. a chain, wire or string.

To prevent the freely movable ornamental components from grouping together at the bottom of the elongated member, or to group freely movable beads in certain areas of the elongated member, an ornamental component provided with a gripping mechanism configured to grip the elongated member may be used. A resilient element may be used as gripping mechanism.

A variety of such ornamental components have been suggested in the prior art. Examples of prior art variations of such an ornamental component is disclosed in Applicant's WO 2014/121798 A1, WO 2014/121797 A1, WO 2017/013066 A1 or WO 2017/013067 A1, the contents of which are included by reference in their entireties herein.

In these documents, different variations of gripping mechanisms formed in a resilient material, such as silicone, are disclosed. The resilient material will deform when it is forced against the elongated member, when the ornamental component is positioned on the elongated member. This deformation results in a spring force as the resilient material will attempt to restore its original shape. This spring force will releasably secure the ornamental component to a selected position on the elongated member.

WO 2014/121798 A1 and WO 2014/121797 A1 describe an ornamental component that may be releasably secured at selected positions along an elongated member. This ornamental component comprises a self-supporting housing having a through hole, a first tubular element and a locking element comprising an engagement portion attached to the first tubular element. The ornamental component further comprises a gripping element for frictionally gripping a part of the elongated member. The first tubular element is configured to secure the gripping element inside the through hole of the ornamental component.

This solution is successful with elongated members with a substantially consistent diameter. However, some necklaces and bracelets are equipped with stopping members (having a lager diameter than the elongated member) distributed along the elongated member of the necklace/bracelet. These stopping members divide the elongated members into sections, wherein a freely movable ornamental component arranged on one such section is not able to be strung along the elongated member past the stopping member. The user may therefore be prevented from positioning the ornamental component at the position of the stopping members on the elongated member. Necklaces and bracelets with examples of such stopping members including bands to which a clip may be attached are disclosed in WO 2005 009166 A2, which is included herein by reference in its entirety.

This drawback was overcome in the Applicant's WO 2017/013066 A1 and WO 2017/013067 A1, which disclose a clip type ornament or clip with a resilient element. The resilient element comprises a gripping surface for frictionally gripping the elongated member, which allows the clip to be releasably secured at selected positions along the elongated member including at the position of the stopping member, since the ornamental component is adapted to accommodate the stopping member.

SUMMARY

On this background it may be an object of the disclosure to improve an ornament as initially described and/or to alleviate, reduce or solve one or more problems and issues in the prior art.

Other objects of the disclosure may include to provide a method for manufacture of such an ornament and a method of assembly of a piece of jewelry comprising such an ornament.

Another object of the disclosure may be to provide a simpler and/or lower cost method for manufacture and/or method of assembly of an ornament.

The disclosure relates, according to one aspect, to an ornament for being strung on an elongated member, such as a chain, string or bangle, of a bracelet or necklace. The ornament includes a shell having a cavity; a first friction element, which allows the ornament to able to be arranged in an un-assembled configuration, in which the first friction element is un-attached to the shell, and an assembled configuration, in which the first friction element is at least partly located in the cavity so as to be attached to the shell; and a through hole, which defines in the assembled configuration an open passageway extending from one opening of the shell, through the shell and to another, opposite opening of the shell. The through hole may allow the ornament to wreathe the elongated member of the bracelet or necklace when the ornament is strung on the bracelet or necklace. The first friction element has a first retaining part, which is arranged in the cavity when the ornament is in the assembled configuration, and a first friction part attached to the first retaining part and comprising a first gripping surface for frictionally gripping a surface of the elongated member when the ornament in the assembled configuration is strung on the elongated member. The ornament, when the ornament in the assembled configuration, is strung on the elongated member, such that it can be releasably secured in a first location on the elongated member and be relocated by a sliding movement along the elongated member to be releasably secured at a second location. The first friction part in an un-deformed state and the first retaining part in an un-deformed state may have different material and/or mechanical properties in the unassembled configuration of the ornament. For example, a difference in hardnesses may act to prevent the first friction element from being detached from the shell during the sliding movement. The shell may have an outer surface and an inner surface, and may further comprise two side walls extending from the inner surface of the shell, the two side walls being configured to grip the first friction element and assist in securing the first friction element in the cavity, so that the first friction element is prevented from being detached from the shell during the sliding movement.

During development of the above described freely moveable prior art ornaments, a problem has been discovered. When an ornamental component is moved along an elongated member from one position to another, friction occurs between the gripping surface of the resilient element and the surface of the elongated member. In this case, the friction is the type called "dry friction", which denotes the force resisting the relative motion of the surfaces in contact with each other. Dry friction is subdivided into static friction between non-moving surfaces, and kinetic friction between moving surfaces.

When the ornamental component is not moving along the elongated member, the elastic element experiences static friction. When a wearer desires to alter the location of the ornamental component, the user exerts a force on the ornamental component in a direction along the elongated member. The friction will increase as the applied force increases until the static friction is overcome, and the ornamental component moves. This maximum value of static friction, when motion is impending, may be referred to as limiting friction.

After the ornamental component moves, the resilient element experiences kinetic friction, which is less than the maximum static friction. The wearer therefore may experience a feeling of easy movement of the ornamental component during movement, and a feeling of the ornamental component being securely attached, when the ornamental component is arranged at a desired position on the elongated member.

The kinetic friction experienced by the resilient element is forceful enough to, in some cases, separate the resilient element from the ornamental component, resulting in a non-function ornamental component. Consequently, many of the suggested solutions have not gained a foothold on the market.

The ornaments of the present disclosure may solve this problem. The ornaments of the disclosure may also provide a versatile and durable ornamental component, which may also be easy and economically advantageous to produce. With the ornaments of the disclosure, a more durable ornament may potentially be provided since the friction element may remain attached to the shell of the ornament during use. The friction element, and thus the ornament, may conveniently also be cost-effective and simple to manufacture. Furthermore, the friction element may allow the ornament to be compatible with jewelry having elongated members with variating diameter due to e.g. stopping members.

The difference in material and/or mechanical properties in the friction element may allow the friction element to comprise one part, i.e. the friction part, which may be adapted to provide the optimal dry friction and deformation level for gripping the surface of the elongated member, and another part, i.e. the retaining part, which may be adapted to provide the optimal dry friction and deformation level to grip parts of the cavity and/or prevent the friction element from being removed from the cavity when the ornament is moved by a sliding motion along the elongated member.

When the friction element is attached to the shell of the ornament by arranging the friction element partly in the cavity, a potentially improved hold of the friction element to the shell may thus significantly reduce or completely avoid the above explained tendency in the prior art related to resilient elements falling out of or being detached from the ornamental components.

In the context of the disclosure, the general term "resilient element" used in connection with the prior art descriptions may be denoted "friction element".

As will be apparent from FIG. 9 explained below, the inventors have tried and failed with solutions having a friction element with the same material properties throughout the entire friction element. Success was achieved when it was realized that the friction element could be provided with a first friction part and a retaining part having different material and/or mechanical properties e.g. hardness as described in the disclosure. Thereby, the friction element may be capable of retaining the ornament in a desired position on the elongated member, being resistant to wear and tear and maintain its attachment to the shell.

In the context of the specification, the term "wreathe" may be understood as meaning to cover, surround, and/or encircle.

In the context of the specification, the term "attached" may be understood as being joined, fastened, and/or connected to something, including being releasably attached.

In the context of the specification, the term "resilient" may be understood as being able to recoil and/or spring partially or completely back into shape after bending, stretching, being compressed, and/or any form of deformation.

In the context of the specification, the term "spaced apart" may be understood as being separated, having spaces between, and/or not being in direct contact.

The friction element may be an element that is deformable under the influence of a particular force and/or capable of recoiling back into substantially its original shape once the particular force is removed.

To define the ornament spatially, the through hole may define a through hole axis extending in an axial direction, with a radial direction extending radially from the axial direction.

The first friction element may be attached to the shell by additional means such as by an adhesive or glue or by welding or by gripping means in the shell.

In some embodiments, the first friction part, when the ornament in the assembled configuration is strung on the elongated member, is substantially continuously in contact with the elongated member before, during and after the sliding movement. Thereby the first friction part may be able to provide continuous dry friction with the elongated member regardless of the sliding movement of the ornament, which may ensure that the wearer can move the ornament from one position to a new, different position in one sliding movement, without having to release the ornament from the elongated member prior to the movement. Furthermore, the continuous contact between the elongated member and the first friction part may ensure that the elongated member will substantially not abut the shell of the ornament, potentially ensuring that the relatively rigid shell will not damage the elongated member during the sliding movement of the ornament.

In some embodiments the one opening of the shell and the other, opposite opening of the shell have a shape and size substantially matching the shape and size of the part of the elongated member of the bracelet/necklace designated for receiving the ornament, whereby at least a part of the surfaces surrounding the openings may function as blocking surfaces for preventing the ornament from being moved over a part of the elongated member having an extended diameter i.e. a diameter that is larger than the diameter of a substantial part of the elongated member.

The diameter of the part having an extended diameter may also be referred to as a width of the elongated member in a radial direction, the radial direction being perpendicular to a longitudinal direction of the elongated member, the longitudinal direction extending along the length of the elongated member.

In some embodiments the first friction part in an un-deformed state and the first retaining part in an un-deformed state have different indentation hardness. In some embodiments the first friction part is of, or includes, a material of a first hardness shore A in an un-deformed state, and the first retaining part is of, or includes, a material of a second, higher hardness shore A in an un-deformed state.

In the context of the specification, the term "x hardness shore A" is to be understood as being a value x on the Durometer Shore A Hardness Scale measured according to ASTM D2240 and measured using the ASTM D2240 type A scale. The hardness is measured in a non-deformed state of the object or material to be measured, i.e. for the friction elements of the ornaments the disclosure, measured in the un-assembled state of the ornament. The final value of the hardness depends on the depth of the indenter after it has been applied for 15 seconds on the material/object.

The term "hardness" in the context of the disclosure may be defined as a material's resistance to permanent indentation. There are different Shore Hardness scales for measuring the hardness of different materials. The Shore A Hardness Scale measures the hardness of flexible mold rubbers that range in hardness from very soft and flexible, to medium and somewhat flexible, to hard with almost no flexibility at all. The scale results in a value between 0 and 100, with higher values indicating a harder material. In embodiments, the second hardness shore A is at least 101, 102, 103, 104, 105, 106, 107, 108, 109, 110, 112, 115, 118, 120, 130, 140, 150, 160, 170, 180, 190, 200, 220, 240, 260, 280. 300, 320, 340, 360, 380, 400, 500, 600, 700, 800, 900 or 1000 percent of the first hardness shore A.

In some embodiments, the first hardness is 1-10, 10-20, 20-30, 30-40, 40-50, 50-60, 60-70, 70-80, 80-90, 90-100 hardness shore A. In some embodiments, the second hardness is 1-10, 10-20, 20-30, 30-40, 40-50, 50-60, 60-70, 70-80, 80-90, 90-100 hardness shore A. In some embodiments, the first hardness is 10-90 shore A, 20-40 shore A, or 25-35 shore A. The second hardness may be 10-100 shore A, 70-90 shore A, or 75-80 shore A. In still other embodiments, the first hardness is between 1-55 shore A and the second hardness is between 55-100 shore A. According to further embodiments, the first hardness is between 25-55 shore A and the second hardness is between 75-100 shore A.

In some embodiments, the first hardness is between 1-35 shore A and the second hardness is between 55-85 shore A. In other embodiments, the first hardness is between 30-55 shore A and the second hardness is at least 75 shore A. In still other embodiments, the first hardness is between 1-50 shore A and the second hardness is at least 51 shore A. According to some embodiments, the first hardness is less than 50 shore A and the second hardness is more than 50 shore A.

The difference in hardness of the first friction element may allow the friction element to comprise two parts having different friction properties due to the difference in hardness, thereby potentially allowing one part to ensure dry friction for gripping the elongated member, and another part to ensure that the first friction element remains in the cavity to thereby remain attached to the shell when the ornament is moved along the elongated member.

In some embodiments, the first friction part of the first friction element comprises a first protrusion which extends from the first friction part and has a first protrusion gripping surface for frictionally gripping a first surface area of the elongated member when the ornament in the assembled configuration is strung on the elongated member. By providing a first friction element having the first protrusion, the ornament may potentially be positioned on parts of the elongated member having different widths/diameters than the surrounding parts of the elongated member, whilst still potentially releasably securing the ornament to the elongated member. For example, the first gripping surface may enable the ornament to grip around parts of the elongated having an extended width such as a band on the elongated member, and the first protrusion gripping surface may grip around the remaining parts of the elongated member having a smaller width than the part gripped by the first gripping surface.

In some embodiments, the first protrusion has a width along the through hole axis of less than 95%, 90%, 80%, 70%, 60%, 50%, 40%, 30% or 20% of the width of the maximal width of the retaining part and/or the friction part along the through hole axis.

In some embodiments, the first protrusion is arranged with a distance to both the one opening of the shell and the other, opposite opening of the shell. The first protrusion and the first friction part may be integrally formed. In the content of this specification the term "integrally formed" may be understood as being a continuous material formation. By providing the first protrusion and the first friction part integrally formed, it may be possible to create, i.e. by molding, the first protrusion and the first friction part as one piece and at the same time, thereby potentially resulting in a simple and easy manufacture of the friction part.

In a further development of the latter embodiments comprising a first protrusion, the first friction part of the first friction element further comprises a second protrusion arranged at a distance to the first protrusion. The second protrusion extends from the first friction part and has a second protrusion gripping surface for frictionally gripping a second surface area of the elongated member when the ornament in the assembled configuration is strung on the elongated member. The second surface area may be different than, and arranged at a distance to, the first surface area, so that the ornament may be releasably secured to parts of the elongated member having different widths/diameters in the radial direction than the adjacent parts of the elongated member. The second protrusion may be integrally formed with the first friction part and/or the first protrusion. The first and second protrusion gripping surfaces may enable the ornament to grip on each side of parts of the elongated having an extended width such as a band on the elongated member, where the first gripping surface may grip around the part of the elongated member having the extended width with respect to the parts grabbed by the first and second protrusion gripping surfaces. The first and second protrusions may provide a stable grip on the elongated member along the length of the ornament and may ensure that the ornament is not able to move past the wider part of the elongated member in both directions along the elongated member.

In some embodiments, the length of the wide part of the elongated member along the length of the elongated member corresponds approximately to the distance between the first protrusion and the second protrusion, so that the friction element of the ornament may fit snugly around the wide part.

The shell, having an outer surface and an inner surface, further comprises two side walls extending from the inner surface of the shell, the two side walls being configured to grip the first friction element and assist in securing the first friction element in the cavity, so that the first friction element is prevented from being detached from the shell during sliding movement. Hereby, the side walls of the shell may assist in securing the first friction element in the cavity, thereby evading the usage of additional external element for securing the first friction element. The production may thereby be made simpler and more cost effective since the production step of firstly producing or purchasing and thereafter inserting an external element such as locking devices is avoided.

In some embodiments, the cavity is shaped so as to grip the first friction element. The cavity may have a depth dimension in the radial direction that is ⅕ to ⅘ of a largest total thickness of the shell in the radial direction. In some embodiments, the cavity has a depth dimension in the radial direction that is about ¼ to ¾, or about ½ of the largest total thickness of the shell in the radial direction. The retaining part may be slightly compressed within the cavity when the ornament is in the assembled configuration to assist in securing the retaining part in the cavity.

In some embodiments, the volume of the part of the friction element that is inserted into the cavity, is smaller than the volume of the cavity, so that, when the ornament is in the assembled configuration, the friction element does not occupy the entire available free space of the cavity. Hereby, a free expansion area may be formed between a bottom of the friction element and a bottom of the cavity, at least when the friction element is in an un-compressed state, thereby potentially allowing the friction element to expand further into the cavity (i.e. into the free expansion space) in response to a force exerted by an elongated member of a bracelet and/or necklace on the friction element when the ornament is strung on the elongated member. This may reduce the stress induced on the friction element during normal use of the ornament.

In some embodiments, the ornament further includes a second friction element. The ornament may be able to be arranged in another un-assembled configuration, in which the second friction element is un-attached to the shell, and another assembled configuration, in which the second friction element is attached to the shell. The second friction element may have a second retaining part, which is arranged to be gripped by the locking element when the ornament is in the assembled configuration. In some embodiments, the second friction element may have a second friction part attached to the second retaining part and a third gripping surface for frictionally gripping a surface of the elongated member when the ornament in the assembled configuration is strung on the elongated member, whereby the ornament, when the ornament in the assembled configuration is strung on the elongated member, can preferably be releasably secured in a first location on the elongated member and be relocated by a sliding movement along the elongated member to be releasably secured at a second location.

Consequently, the first and second friction elements may potentially be secured to the shell of the ornament in an easy and secure manner. This may further allow the friction elements to be secured to the shell with limited use, preferably without the use, of adhesives, thereby potentially simplifying the assembly and manufacturing process, whilst also potentially increasing the aesthetic appearance of the ornament.

In some embodiments, the ornament further comprises a locking element arranged inside the shell, wherein in the assembled configuration, the second friction element is attached to the shell via the locking element.

In some embodiments, the second friction part has a third hardness shore A, and the second retaining part has a fourth, higher hardness shore A. The difference in hardness may act to prevent the second friction element from being detached from the shell during the sliding movement of the ornament along the elongated member. The first friction element may be somewhat compressed in the radial direction by the elongated member when the ornament is in the assembled configuration and, vice versa, the first friction element may exert a force in the radial direction on the elongated member, so that the elongated member may be pushed towards the second friction element.

It is to be understood that the second friction element may be identical to the first friction element. The above material and/or mechanical properties described in relation to the first friction element may therefore also be valid for the second friction element.

In some embodiments the first and second friction elements may be arranged, in an assembled configuration and in a closed state of the ornament, oppositely each other, so that the first friction element grips one side of the elongated member, when the ornament is strung on such a member, and the second friction element grips another side, preferably opposite the one side of the elongated member.

Additionally or alternatively, the second friction element may be somewhat compressed in the radial direction by the elongated member, when the ornament is in the assembled configuration and, vice versa, the second friction element may exert a force in the radial direction on the elongated member, so that the elongated member may be pushed towards the first friction element. This may create tension between the first and second friction elements and the elongated member, so that the ornament may be releasably secured on the elongated member.

The second friction element may be made of a material identical to or similar to the material of the first friction element.

In alternative or additional embodiments, the third hardness shore A is at least 101, 102, 103, 104, 105, 106, 107, 108, 109, 110, 112, 115, 118, 120, 130, 140, 150, 160, 170, 180, 190, 200, 220, 240, 260, 280. 300, 320, 340, 360, 380, 400, 500, 600, 700, 800, 900 or 1000 percent of the first hardness shore A. In some embodiments, the fourth hardness is 1-10, 10-20, 20-30, 30-40, 40-50, 50-60, 60-70, 70-80, 80-90, 90-100 shore A.

In some embodiments, the third hardness is 10-90 shore A, 20-40 shore A, or 25-35 shore A. The fourth hardness may be 10-100 shore A, 70-90 shore A, or 75-80 shore A.

In some embodiments, the third hardness is between 1-55 shore A and the fourth hardness is between 55-100 shore A. In other embodiments, the third hardness is between 25-55 shore A and the fourth hardness is between 75-100 shore A. In still other embodiments, the third hardness is between 1-35 shore A and the fourth hardness is between 55-85 shore A. According to further embodiments, the third hardness is between 30-55 shore A and the fourth hardness is at least 75 shore A. According to still other embodiments, the third hardness is between 1-50 shore A and the fourth hardness is at least 51 shore A. In some embodiment, the third hardness is less than 50 shore A and the fourth hardness is more than 50 shore A.

In some embodiments, the first friction element and/or the second friction element are/is manufactured from a material comprising at least 10%, at least 20%, at least 30%, at least 40%, at least 50%, at least 60%, at least 70%, at least 80%, at least 90% or at least 95% of a silicone material and/or a silicone compound and/or a material or a combination of materials selected from the group consisting of silicone, silicone rubber, natural rubber, synthetic rubber, PTFE, polyethylene, polypropylene, HDPE, polystyrene and nylon. A material of the first and/or second friction element may comprise additives and/or fillers, including coloring agents and/or softening agents.

The second friction element may be approximately identical to the first friction element in some or all aspects, including material composition and shape.

In some embodiments, the locking element is or comprises a flange, or two flanges, extending along the through hole axis and is configured to grip the second friction element and secure it to the shell. Consequently, when the ornament is in the form of a clip or a clip type ornament, the second friction element may potentially be attached efficiently to the shell, while potentially still providing room for arranging a closing element in the shell.

In some embodiments, the second friction element is arranged within the shell approximately opposite the first friction element.

The locking element may be arranged opposite the cavity.

In a further development of the above embodiments comprising a second friction element, the second friction part of the second friction element comprises a third protrusion. The third protrusion extends from the second friction part and has a third protrusion gripping surface for frictionally gripping a third surface area of the elongated member when the ornament in the assembled configuration is strung on the elongated member. The second friction part of the second friction element may further include a fourth protrusion preferably arranged at a distance to the second protrusion. The fourth protrusion may extend from the second friction part and have a fourth protrusion gripping surface for frictionally gripping a fourth surface area of the elongated member when the ornament in the assembled configuration is strung on the elongated member.

The fourth surface area may be different from, and potentially arranged at a distance from, the third surface area, so that the ornament may potentially be releasably secured to parts of the elongated member having different widths/diameters.

In some embodiments the fourth protrusion has a width along the through hole axis of less than 95%, 90%, 80%, 70%, 60%, 50%, 40%, 30% or 20% of the width of the maximal width of the second retaining part and/or the second friction part along the through hole axis. The fourth protrusion may be arranged with a distance to both the one opening of the shell and the other, opposite opening of the shell.

In some embodiments, the fourth protrusion and the second friction part are integrally formed. The fourth protrusion may be integrally formed with the second friction part and/or the third protrusion.

The shell may provide the primary structural strength of the ornament and/or may be self-supporting. The shell may alternatively be denoted "a housing".

The shell may be made of or include metal, glass, wood, plastic material, ceramics or a combination thereof. Ornamental components such as gem stones or patterns may be included in an outer surface of the shell.

The ornament may have any outer shape, such as round, tubular, spherical or rectangular. Correspondingly, the through hole of the ornament in the assembled configuration may have any shape, such as round or rectangular.

In some embodiments, the ornament is a clip type ornament with a first part and a second part, the two parts preferably being hinged to each other. The first and second parts of the clip may be individually integrally molded. In such embodiments, the ornament may be capable of being arranged in a closed state and an open state. A clip type ornament may be understood as component that can be clipped on a bracelet and/or necklace for ornamental purposes.

In a further development of the latter embodiment the first part comprises a closing element for releasably securing the first and second part to each other in the closed state of the ornament. Additionally or alternatively, the closing element is arranged inside the ornament, so that the ornament encloses the closing element in the closed state. In some embodiments, the closing element is a leaf spring arranged inside the first part, a part of the leaf spring preferably extending out of the first part and in the closed state of the clip preferably extending into the second part. Consequently, a clip type ornament may be provided which is exempt from having an external closing mechanism obstructing the aesthetic appearance of the ornament, thus allowing a more freely design of the exterior surface of the ornament. The second part may include a closing cavity for receiving the part of the leaf spring extending out of the first part and in a closed state of the ornament extending into the second part. Additionally or alternatively, the closing cavity comprises a closing protrusion, which provides a releasable snap-lock with the part of the spring extending from the first part in a closed state of the ornament. Additionally or alternatively, the shell of the clip type ornament comprises two half shells which may be hingedly connected.

In some embodiments the shell and/or the ornament has the overall shape of a ball or sphere or a tube. In the case of a spherical clip type shell or ornament, the shell and/or ornament may comprise two half shells or half parts, each being shaped as a semi or half sphere. The half shells or half parts may be hingedly connected to each other. In further developments of the embodiments comprising two half shells, the cavity of the shell may be provided in one of the half shells. In case the ornament comprises the second friction element, the latter may be positioned in a cavity of the other half shell.

In some developments of the embodiments comprising a second friction element, the second friction element is arranged on top of the closing element and may at least partly secure the closing element to the first part.

In some embodiments, the first and/or the second gripping surfaces and/or the first and/or the second and/or the third and/or the fourth protrusion gripping surfaces is/are (a) smooth even surface(s).

According to a second aspect, the disclosure relates to a jewelry system which can be assembled to form a piece of jewelry such as a bracelet or a necklace. The jewelry system includes an elongated member, such as a chain, string or bangle, of a bracelet or necklace, and an ornament of the first aspect of the present disclosure. When the ornament is strung on the elongated member, the ornament can preferably be releasably secured in a first location on the elongated member and be relocated by a sliding movement along the elongated member to be releasably secured at a second location.

The elongated member may be any elongated member suitable for jewelry such as a metal chain, or any other type of chain, which may or may not include chain joints, a leather string or a fabric string. The elongated member may comprise several strings, chains or strands that are woven together. The elongated member may comprise several strings, chains or strands that extend alongside each other, but are not connected to each other, except, potentially, at their ends.

In some embodiments, the jewelry system further comprises at least one freely moveable ornamental component strung on the elongated member. Additionally or alternatively, the jewelry system may comprise two or more ornaments of the first aspect of the present disclosure. The jewelry system may comprise further jewelry ornaments, wherein an ornament according to the disclosure potentially acts as a stopping member preventing bunching or grouping of the further ornaments on the elongated member.

In some embodiments, the second friction part, when the ornament in the assembled configuration is strung on the elongated member, is substantially continuously in contact with the elongated member before, during and after the sliding movement.

The jewelry system may further comprise a band fixed to the elongated member, the band potentially having an extended width/diameter compared with the width of remaining parts of the elongated member, wherein the ornament is configured so that the first and second gripping surfaces grips the band to allow the ornament to be releasably attached to the band. The width of the band may extend in an axial or longitudinal direction of the elongated member.

The band may be a band as disclosed in the above-mentioned WO 2005 009166 A2. The jewelry system may comprise at least two bands. A band may be provided at one or both ends of the elongated member. One, two, or more bands may be provided on the elongated member at a distance from the ends of the elongated member.

The elongated member may be elastic or flexible. The elongated member may be provided as a loop shape, i.e. not comprising ends or ends that are permanently attached to each other. In some embodiments, the elongated member comprises two ends and a closing mechanism such as a lock. The closing mechanism may be adapted to connect the ends of the elongated member, so that the elongated member and the closing mechanism forms a closed loop. For example, in case the elongated member is of the bangle type, no such lock need be included. The closing mechanism may be an openable closing mechanism, so the wearer may potentially easily put on the jewelry system.

As will be realized by a person skilled in the art, the ornament of the first aspect of the present disclosure may conveniently be manufactured by the method of the third aspect of the present disclosure described in the following.

According to a third aspect, the disclosure relates to a method of manufacture of the ornament of the first aspect of the disclosure, wherein the first friction element is manufactured by separately manufacturing the first friction part and the first retaining part and subsequently attaching them to each other, wherein the subsequent attachment is preferably done by vulcanization, and/or the second friction element is manufactured by separately manufacturing the second friction part and the second retaining part and subsequently attaching them to each other, wherein the subsequent attachment is preferably done by vulcanization. Alternatively, the parts of the first and/or second friction elements are subsequently attached by molding, gluing or welding or other means. The first and/or second friction element may be molded directly into the respective cavity.

According to a fourth aspect, the disclosure relates to a method for assembly of the ornament of the first aspect, comprising the steps of: providing the ornament and providing the first friction element. The first friction element includes a first wing and a second, opposite, wing, which extend away from each other. The first and second wings are preferably formed by the retaining part and/or by the friction part. The method further includes inserting the first wings of the first friction element into the cavity, and applying a force to the first friction element, so that the second wing, and thereby the first retaining part of the friction element, is snapped into the cavity. The entire first retaining part is thereby arranged in the cavity, so that the second hardness shore A of the first retaining part acts to prevent the first friction element from being detached from the shell during the sliding movement of the ornament.

In some embodiments, the second friction element comprises a third wing and a fourth, opposite wing. The third and fourth wings extend away from each other, and are preferably formed by the retaining part and/or by the friction part.

Additionally or alternatively the method also comprises the steps of: inserting the third wings into the cavity, and applying a force to the second friction element, so that the fourth wing, and thereby the second retaining part of the second friction element, is snapped into the cavity and the entire second retaining part is thereby arranged in the cavity.

During assembly of the ornament, the first and/or second resilient part(s) may thus potentially be readily arranged in the cavity, potentially using the resilience of the material to compress it to fit through an opening of the cavity. When inserted into the cavity, the first and/or second resilient part(s) may again expand to fit into the cavity and be secured therein, potentially providing for an easy and simple assembly step during the manufacturing process.

In embodiments, the first and/or a second friction element is/are manufactured by molding and/or 3D printing and/or cut from a base material. In some embodiments, the first and/or a second friction element is/are manufactured by providing an uncooked material, e.g. silicone, then molding the retaining part, subsequently molding the friction part to the retaining part and subsequently subject the friction element to vulcanization.

In some embodiments, the first and/or a second friction element is/are manufactured by providing an uncooked material, e.g. silicone, then molding the friction part, subsequently molding the retaining part to the friction part and subsequently subject the friction element to vulcanization.

The surface of the friction part that faces the retaining part, when the friction element is assembled, or the surface of the retaining part that faces the friction part, when the friction element is assembled, may be shaped as uneven surfaces (e.g. being serrated, having protrusions, having indentations), the surfaces respectively matching each other's different surface variations, so as to provide a larger surface area for attachment and thereby more stable assembly. As will be realized by a person skilled in the art, the ornaments of the disclosure may potentially conveniently be assembled by the method of the fourth aspect of the disclosure.

The different aspects of the disclosure can be implemented in different ways, including as an ornament, bracelets or necklaces comprising an ornament, and methods of assembling or of manufacture of an ornament as described above and in the following, each potentially yielding one or more of the benefits and advantages described in connection with at least one of the aspects described above, and each having one or more embodiments corresponding to the embodiments described in connection with at least one of the aspects described above and/or disclosed in the dependent claims.

Furthermore, it will be appreciated that embodiments described in connection with one of the aspects described herein may equally be applied to the other aspects.

BRIEF DESCRIPTION OF THE DRAWINGS

The above and/or additional objects, features and advantages of the disclosure will be further elucidated by the following illustrative and non-limiting detailed description of embodiments with reference to the appended drawings.

DETAILED DESCRIPTION OF EMBODIMENTS

Figure 1A:
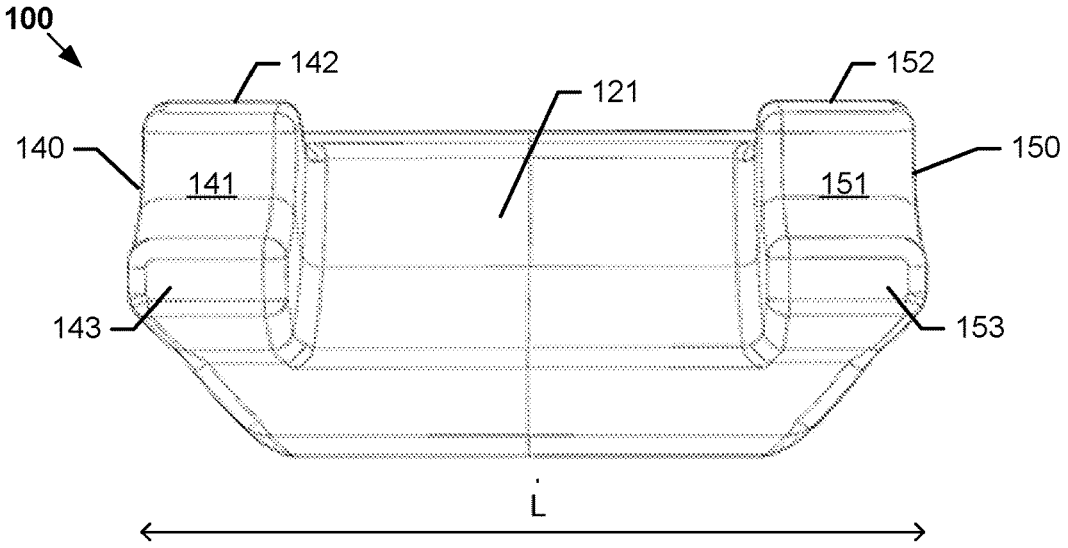
FIGS. 1A-C show a friction element of an embodiment of an ornament of the first aspect of the disclosure.
Figure 1B:
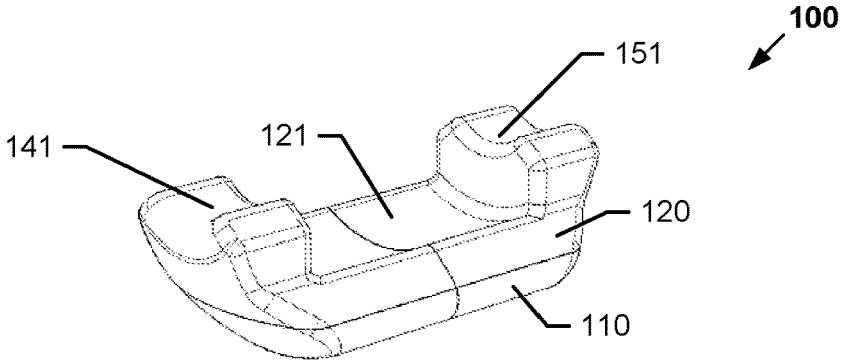
Figure 1C:
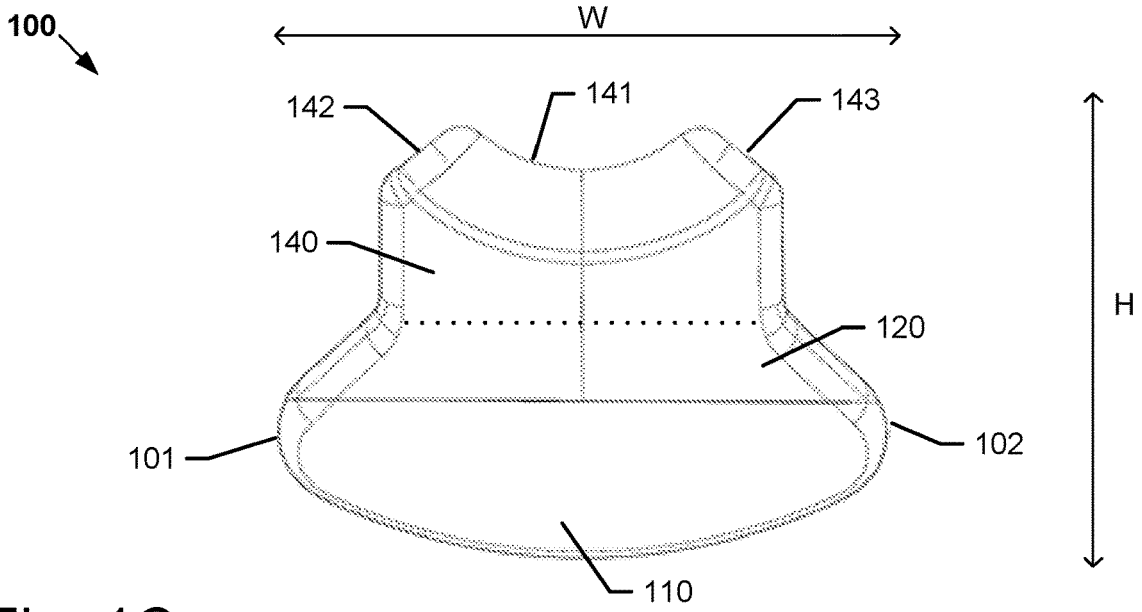

In the following description, reference is made to the accompanying figures, which show, by way of illustration, how the disclosure may be practiced. Turning to FIGS. 1A-C and FIGS. 2A-B, FIGS. 1A-C show part (a friction element) of an ornament 1 of an embodiment of the first aspect of the disclosure. FIGS. 1A and 1B show perspective views, and FIG. 1C shows an end/top view. In the following, FIGS. 1A-C are explained in relation to a first friction element, denoted 100, but it is to be understood that the same description may apply to a second friction element, denoted 200.

Figure 2A:
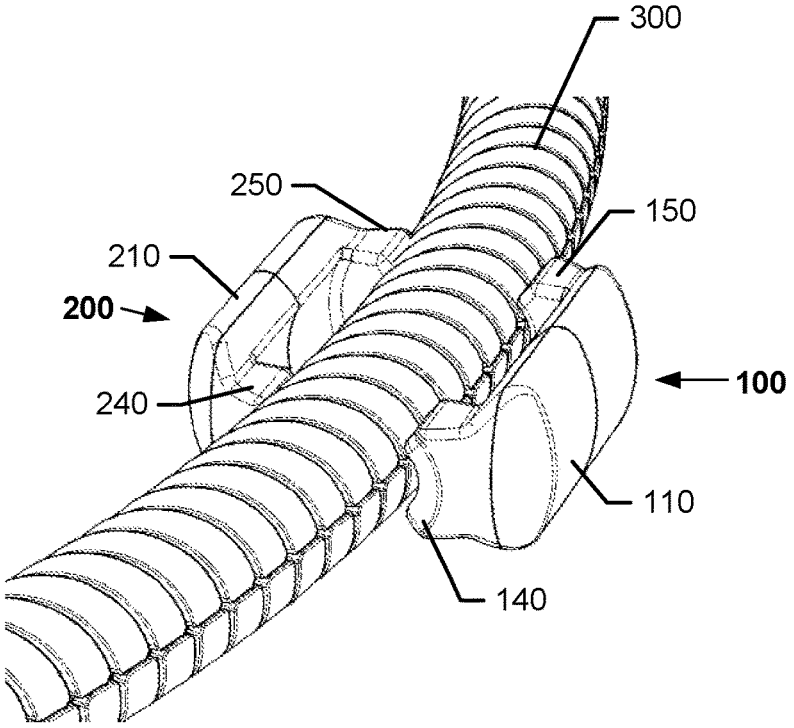
FIGS. 2A-B show a first friction element and a second friction element of an embodiment of ornament of the disclosure, the friction elements being positioned on an elongated member.
Figure 2B:
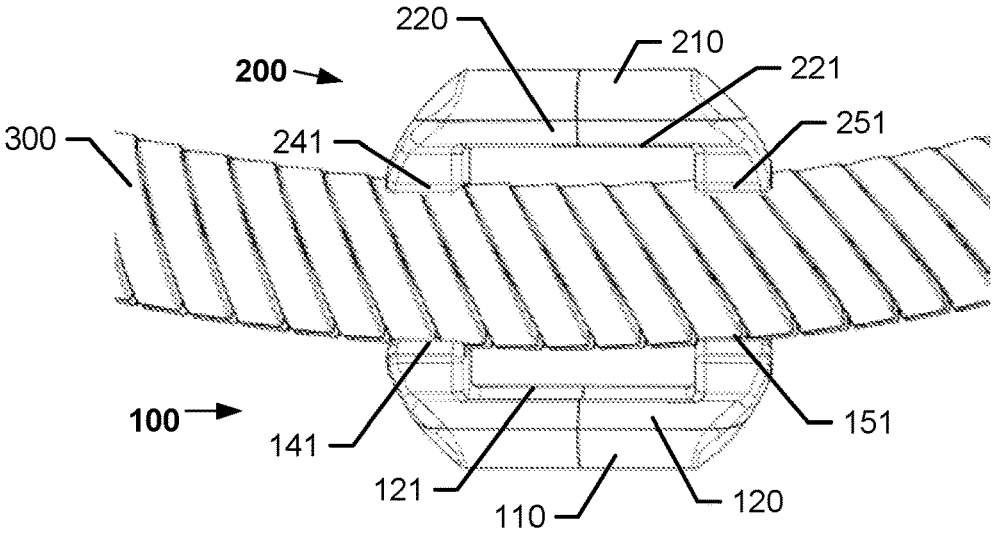

FIGS. 2A-B show the first friction element 100 and the second friction element 200 positioned on an elongated member 300. These figures illustrate how the friction elements 100, 200 may be arranged on the elongated member 300 when the ornament 1 is strung on the elongated member 300. Besides the friction elements 100, 200, nothing else of the ornament is shown in those figures.

Figure 7A:
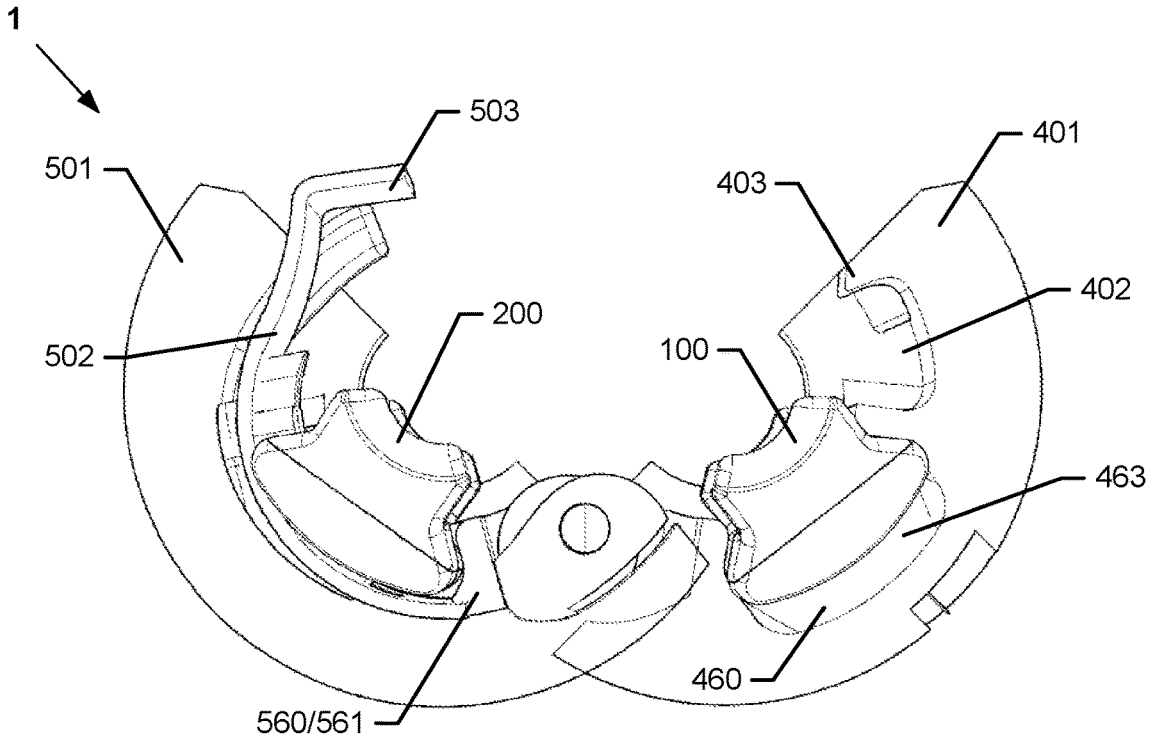
FIGS. 7A-C show the ornament of FIGS. 2A-B in the form of a clip, in an open and a closed state, respectively.
Figure 7B:
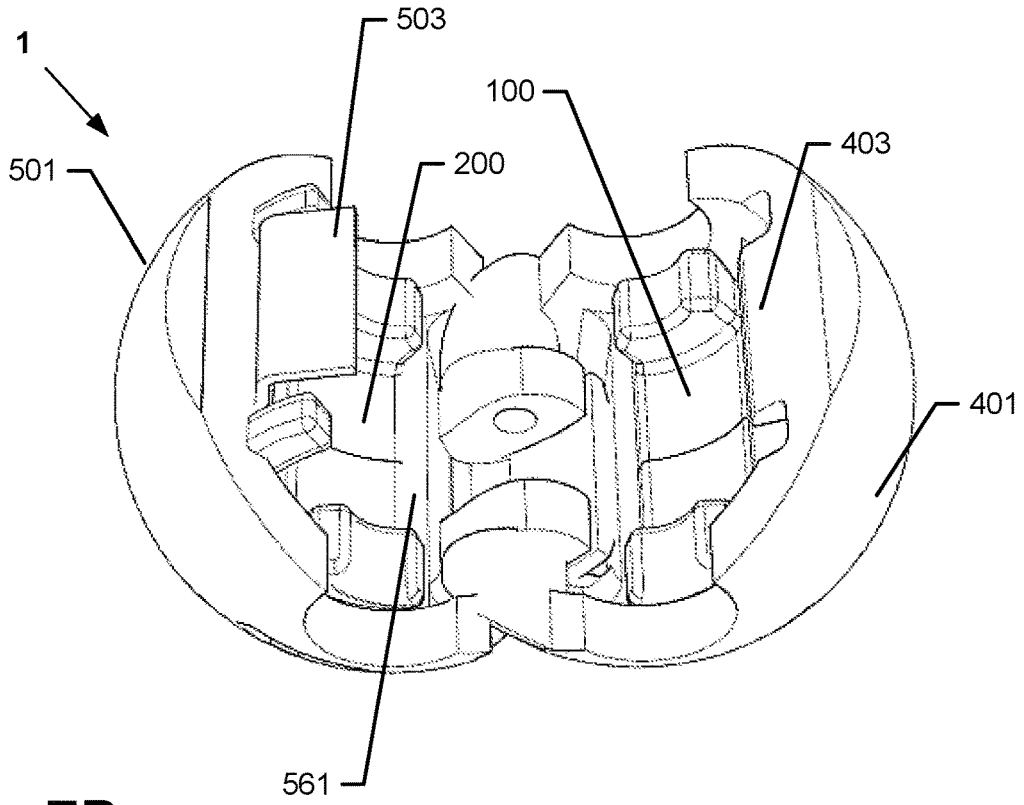

The first friction element 100 comprises a first retaining part 110, which is adapted to be arranged in a cavity of an ornament 1 as shown in e.g. FIGS. 7A-B when the ornament 1 is in an assembled configuration, wherein the first friction element 100 is attached to the ornament 1.

Figure 3A:
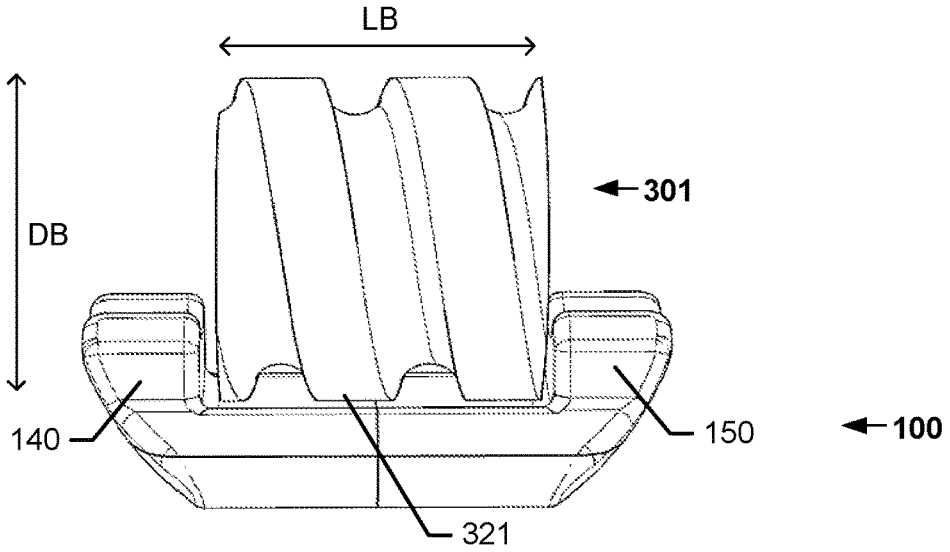
FIGS. 3A-C show the first friction element and the second friction element of FIGS. 2A-B positioned on an elongated member having a wide part.

The first friction element 100 further comprises a first friction part 120 attached to the first retaining part 110. The first friction part 120 comprises a first gripping surface 121 for frictionally gripping a surface 321 of an elongated member (as shown in FIG. 3A) when the ornament 1 in the assembled configuration is strung on the elongated member 300, whereby the ornament 1, when the ornament is in the assembled configuration is strung on the elongated member 300, can be releasably secured in a first location on the elongated member 300 and be relocated by a sliding movement along the elongated member 300 to be releasably secured at a second location on the elongated member 300.

The first friction part 120 in an un-deformed state, and the first retaining part 110 in an un-deformed state, have different material and/or mechanical properties in the unassembled configuration of the ornament. The first friction part 120 has a first hardness shore A, and the first retaining part 110 has a second, higher hardness shore A. The difference in hardness acts to prevent the first friction element 100 from being detached from a shell of the ornament during the sliding movement.

In embodiments, the second hardness shore A of the retaining part 110 is at approximately 266 percent higher than the first hardness shore A of the friction part 120. The first hardness of the friction part 120 may be approximately 30 shore A, and the second hardness of the retaining part 110 may be approximately 80 shore A.

The first friction part 120 of the first friction element 100 comprises a first protrusion 140 which extends from the first friction part 120. The first protrusion 140 has a first protrusion gripping surface 141 for frictionally gripping a first surface area 341 of the elongated member 300 when the ornament 1 in the assembled configuration is strung on the elongated member as seen in FIGS. 2A-B.

The first protrusion gripping surface 141 has a concave shape (in a plane being perpendicular to a longitudinal axis L extending in the axial direction) so as to match the surface of the elongated member 300. When the ornament 1 is in the assembled configuration, the longitudinal axis L is parallel with the through hole axis A of the ornament. The first protrusion gripping surface 141 is a smooth even surface.

The first protrusion 140 further comprises two, opposite, side surfaces 142, 143. The side surfaces 142, 143 are arranged at an angle with respect to each other. The angle may be approximately 90 degrees. These side surfaces assist in minimizing sharp angles that could potentially shear off/break off during use.

As seen in FIG. 1C, the first friction element 100 comprises a first wing 101 and a second, opposite, wing 102. The first wing 101 and the second wing 102 extend away from each other in a direction perpendicular to the longitudinal axis L. The first and second wings 101, 102 are in this embodiment formed partly by the retaining part 110 and partly by the friction part 120.

The friction element 100 defines a height H (extending in the radial direction of the ornament when the ornament is in the assembled configuration as seen in FIG. 7A) and a width W along a reference axis being perpendicular to the longitudinal axis L. The maximum width of the friction part 120 is larger than the maximum width of the first protrusion 140. The maximum width of the retaining part 110 is larger than the maximum width of the first protrusion 140. The first protrusion 140 extends along the longitudinal axis L defining a depth of the first protrusion.

The depth is approximately 2.4 mm. The maximum length of the first friction element is approximately 7.8 mm. The maximum width of the friction element is approximately 3.9 mm. The maximum height of the friction element is approximately 2.7 mm. The maximum height of the retaining part is approximately 1 mm.

The first protrusion 140 and the first friction part 120 may be integrally formed. Thus, the first protrusion 140 may comprise the same material as the first friction part 120 and thereby has the same first hardness shore A.

The first friction part 120 further comprises a second protrusion 150. The second protrusion 150 is arranged at a distance to the first protrusion 140 along the longitudinal axis L. The first gripping surface 121 is visible in the distance between the first and second protrusion and thus separates the first and second protrusions in the longitudinal direction L.

Figure 3B:
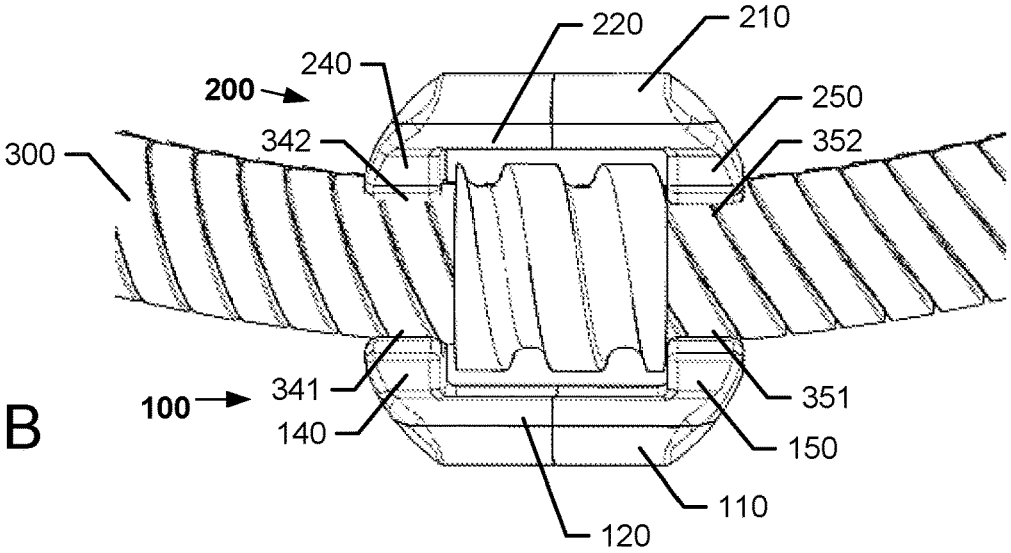
Figure 3C:
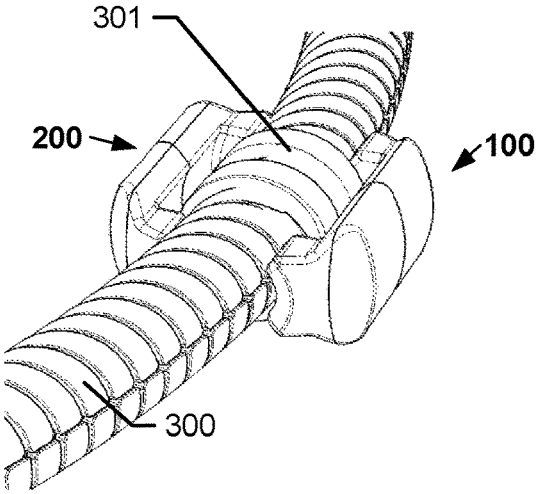

The second protrusion 150 extends from the first friction part 120 and has a second protrusion gripping surface 151 for frictionally gripping a second surface area 351 of the elongated member when the ornament in the assembled configuration is strung on the elongated member (as seen in FIG. 3B). The second surface area 351 is different from, and arranged at a distance to, the first surface area 341, so that the ornament may be releasably secured to parts of the elongated member 300 having different widths, e.g. when the elongated member comprises a band 301 as shown in FIGS. 3A-C.

The length LB of the band 301 is less than the distance between the first and second protrusions 140, 150, which enables the ornament 1 via the first friction element 100 to grip around the band on the elongated member 300. The first protrusion gripping surface 141 grips the elongated member 300 at the first surface area 341 of the elongated member 300 on one side of the band 301, and the second protrusion gripping surface 151 grips the other side of the elongated member 300 at the second surface area 351 of the elongated member on the other side of the band 301. Depending on the diameter DB of the band 301, the first gripping surface 121 may also grip the surface 321 of the elongated member, in this case the surface of the band 301.

The second protrusion gripping surface 151 has a concave shape (in a plane being perpendicular to a longitudinal axis L extending in the axial direction) so as to match the surface of the elongated member 300. The second protrusion gripping surface 151 may be a smooth even surface. Likewise, the gripping surface 121 may be a smooth even surface.

The second protrusion 150 further comprises two, opposite side surfaces 152, 153. The side surfaces 152, 153 are arranged at an angle with respect to each other. The angle is approximately 90 degrees.

The second protrusion 150 and the first friction part 120 are integrally formed. Thus the second protrusion 150 comprises the same material as the first friction part 120 and thereby has the same first hardness shore A.

When the ornament 1 in the assembled configuration is strung on the elongated member 300, the first and second protrusion gripping surfaces 141, 151 are substantially continuously in contact with the surface of the elongated member before, during and after the sliding movement of the ornament 1.

As seen in FIGS. 2A-B, the ornament 1 further comprises a second friction element 200.

The ornament 1 is able to be arranged in an un-assembled configuration, in which the first and second friction elements 100, 200 are un-attached to or detached from the shell of the ornament, and an assembled configuration (as seen in FIGS. 7A-B), in which the first and second friction elements 100, 200 are attached to the shell.

The above described features relating to the first friction element 100 may also apply to the second friction element 200. But for clarification in relation to the figures, the second friction element 200 is shortly described in the following.

Figure 6A:
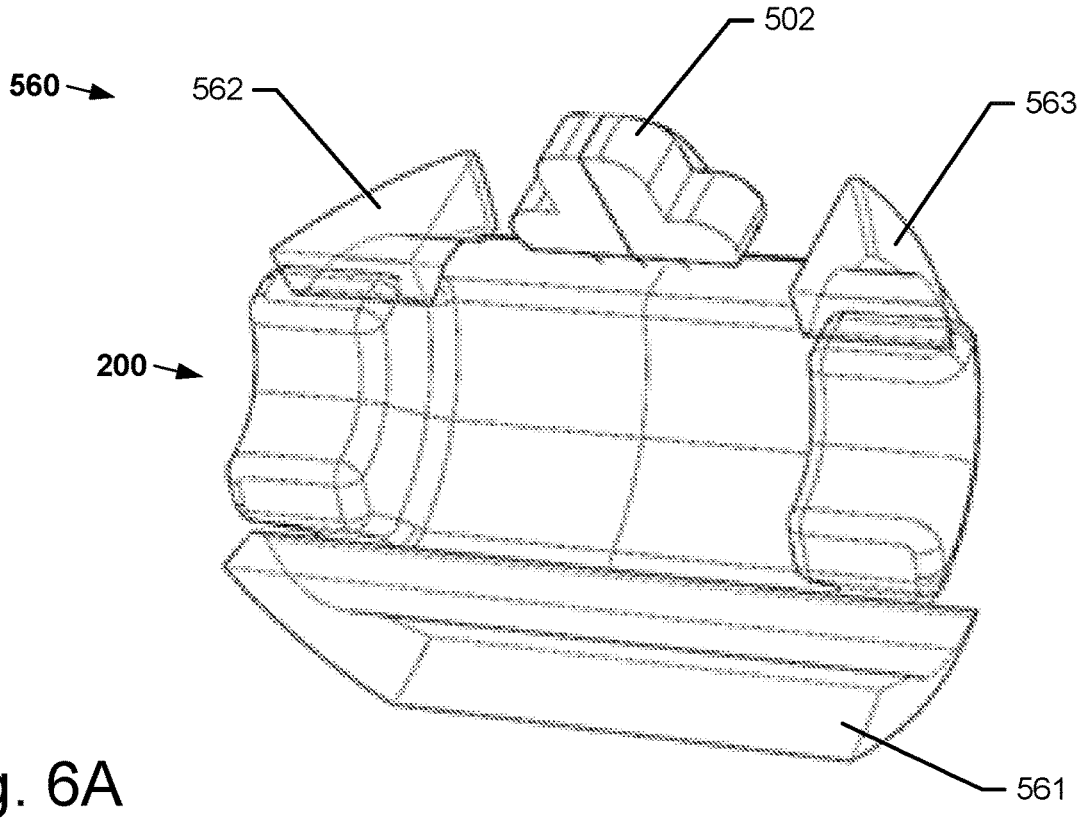
FIGS. 6A-B show the second friction element of FIGS. 2A-B gripped by a locking element.
Figure 6B:
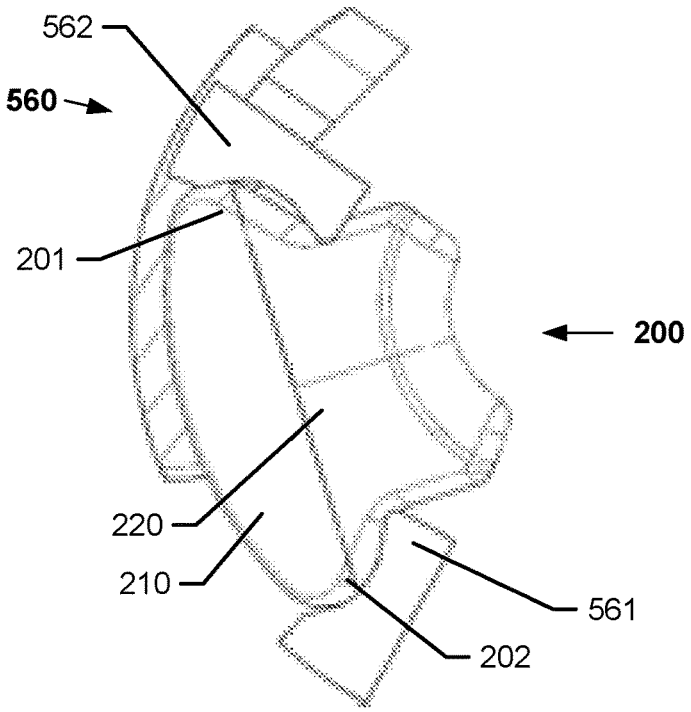

The second friction element 200 comprises a second retaining part 210, which is arranged to be gripped by a locking element 560 (as shown in FIGS. 6A-B) when the ornament 1 is in the assembled configuration. The second friction element 200 further comprises a second friction part 220 attached to the second retaining part 210 and comprising a third gripping surface 240 for frictionally gripping a surface of the elongated member 300 when the ornament in the assembled configuration is strung on the elongated member.

The second friction part 220 has a first hardness shore A, and the second retaining part 210 has a second, higher hardness shore A. The second hardness shore A of the second retaining part 210 may be 266 percent of the first hardness shore A of the second friction part 220. In embodiments, the first hardness of the second friction part 220 may be approximately 30 shore A, and the second hardness of the second retaining part 210 may be approximately 80 shore A.

The second friction part 220 comprises a third protrusion 240. The third protrusion 240 extends from the second friction part 220. The third protrusion 240 has a third protrusion gripping surface 241 for frictionally gripping a third surface area 342 of the elongated member 300 when the ornament 1 in the assembled configuration is strung on the elongated member 300 as seen in FIGS. 2A-B.

The third protrusion gripping surface 241 has a concave shape so as to match the surface of the elongated member 300. The third protrusion gripping surface 241 may be a smooth even surface. The third protrusion 240 further comprises two, opposite, side surfaces 242, 243, which are arranged at an angle with respect to each other. The angle is approximately 90 degrees.

As seen in FIG. 6B, the second friction element 200 comprises a first wing 201 and a second, opposite, wing 202, the wings 201, 202 extending away from each other. The first and second wings 201, 202 are formed partly by the second retaining part 210 and partly by the second friction part 220.

The dimensions of the second friction element 200 correspond in this embodiment to the dimensions of the first friction element 100 as described above.

The third protrusion 240 and the second friction part 220 may be integrally formed. Thus the third protrusion 240 may comprise the same material as the second friction part 120 and thereby has the same first hardness shore A.

The second friction part 220 further comprises a fourth protrusion 250. The fourth protrusion 250 is arranged at a distance to the third protrusion 240 along the longitudinal axis L. The second gripping surface 221 is visible in the distance between the first and second protrusion and thus separates the first and second protrusions in the longitudinal direction L.

The fourth protrusion 250 extends from the second friction part 220 and has a fourth protrusion gripping surface 252 for frictionally gripping a fourth surface area 352 of the elongated member when the ornament in the assembled configuration is strung on the elongated member (as seen in FIG. 3B). The fourth surface area 352 is different from, and arranged at a distance to, the third surface area 342.

The length of the band 301 is less than the distance between the third and fourth protrusions 240, 250. The third protrusion gripping surface 241 grips the elongated member 300 at the third surface area 342 of the elongated member on one side of the band 301, and the fourth protrusion gripping surface 251 grips the other side of the elongated member 300 at the fourth surface area 352 of the elongated member on the other side of the band 301.

As seen in FIGS. 3B-C the first friction element 100 is positioned on the side of the elongated member 300 opposite from the second friction element 200 when the ornament is strung on the elongated member 300. This ensures that the entire shell of the ornament 1 is positioned at a distance to the elongated member 300, so that when the ornament 1 by a sliding motion is moved along the elongated member 300, the hard shell will have limited, preferably no, contact with the elongated member. This ensures a prolonged lifespan of the elongated member 300, since the shell will contribute minimally to the wear and tear of the elongated member 300.

The fourth protrusion gripping surface 251 has a concave shape to match the surface of the elongated member 300. The fourth protrusion gripping surface 251 may be a smooth even surface. Likewise, the second gripping surface 221 may be a smooth even surface.

The fourth protrusion 250 further comprises two, opposite, side surfaces 252, 253. The side surfaces 252, 253 are arranged at an angle with respect to each other. The angle is approximately 90 degrees. The fourth protrusion 250 and the second friction part 220 may be integrally formed. Thus the fourth protrusion 250 may comprise the same material as the second friction part 220 and thereby has the same first hardness shore A.

When the ornament 1 in the assembled configuration is strung on the elongated member 300, the third and fourth protrusion gripping surfaces 241, 251 are substantially continuously in contact with the surface of the elongated member 300 before, during and after the sliding movement of the ornament 1.

As seen in FIGS. 3B-C, depending on the width of the wide part i.e. the band 301 of the elongated member, the first gripping surface 121 may abut the band 301, if the distance from the surface of the elongated member 300 to the surface of the band 301 is approximately equal to or larger than the height of the highest of the protrusions (e.g. 140, 150) of the friction element 100.

When the ornament 1 in the assembled configuration is strung on the elongated member 300, the first protrusion 140 extends towards the third protrusion 240 and, vice versa, the first and third protrusion gripping surfaces 141, 241 grip each side of the elongated member 300. Furthermore, the second protrusion 150 extends towards the fourth protrusion 250 and, vice versa, the second and fourth protrusion gripping surfaces 151, 251 grip each side of the elongated member 300.

Figure 7C:
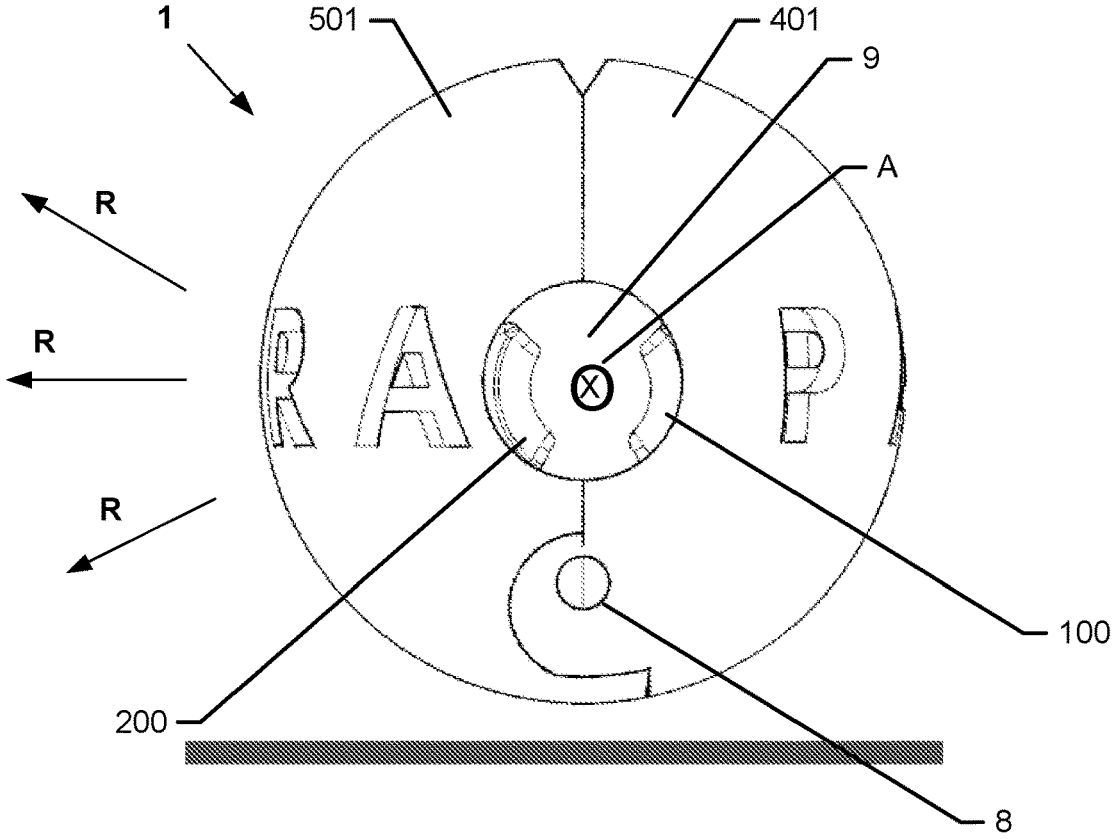
Figure 10:
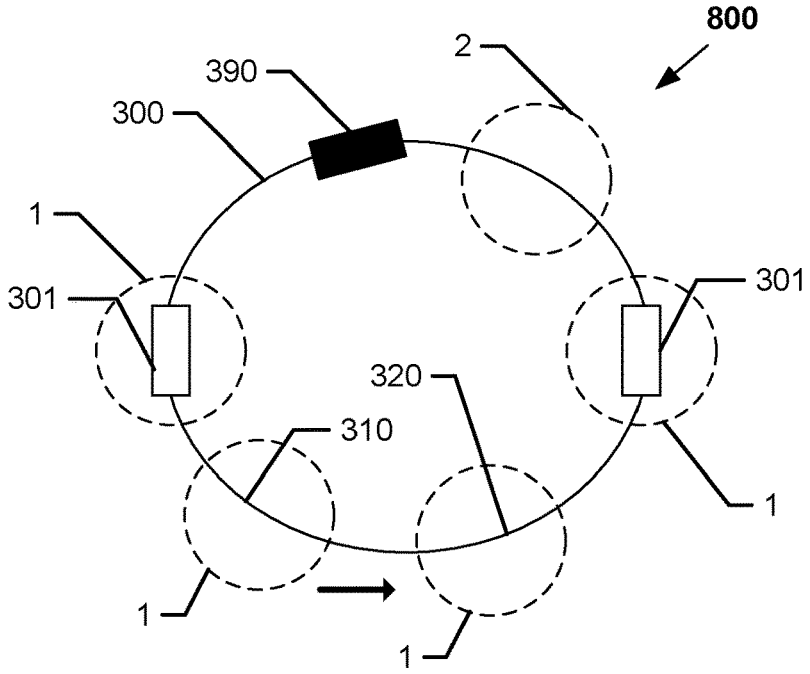
FIG. 10 shows schematically a jewelry system of the second aspect of the disclosure.

Turning to FIGS. 7A-C, which show the ornament 1 for being strung on the elongated member 300, which is a string formed of metal strands, of a bracelet 800 shown in FIG. 10. FIGS. 7A-B show the ornament 1 in an assembled configuration and in an open state. FIG. 7C shows the ornament in an assembled configuration and in a closed state.

The ornament 1 comprises a shell (here shown in two parts or half shells 401, 501) having a cavity 460. The ornament 1 further comprises a first friction element 100. The ornament 1 is able to be arranged in an un-assembled configuration, in which the first friction element 100 is un-attached to the shell part 401, and an assembled configuration, in which the first friction element 100 is at least partly located in the cavity 460 so as to be attached to the shell part 401.

The ornament 1 further comprises a locking element 560 arranged inside the shell 501 and a second friction element 200, the ornament 1 being able to be arranged in another un-assembled configuration, in which the second friction element 200 is un-attached to the shell, and another assembled configuration, in which the second friction element 200 is attached to the shell 501 via the locking element 560.

As seen in FIG. 7C, the ornament 1 further comprises a through hole 9, the through hole defining in the assembled configuration an open passageway extending from one opening 91 of the shell and, through the shell and to another, opposite opening 92 of the shell, the through hole allowing the ornament 1 to wreathe the elongated member 300 of the bracelet when the ornament 1 is strung on the bracelet. The through hole 9 is defined by the first protrusion gripping surface 141, the second protrusion gripping surface 151, the third protrusion gripping surface 241, the fourth protrusion gripping surface 251, the shell 401, 501 as well as by the two openings 91, 92 (illustrated in FIGS. 4B and 5B).

The ornament 1 is a clip type ornament 1. The ornament 1 comprises two shell parts 401, 501, that are hinged to each other by means of a well-known type hinge 8, which could be replaced by other suitable hinge types. The hinge 8 links the two shells 401, 501 to each other, so as to form a spherical shell, when the ornament is in the closed state. The hinge 8 allows the two shells rotate relative to each other about a fixed axis of rotation, when the ornament is brought from the closed to the open state. As seen on FIG. 8E each shell comprises a part 81, 82 of the hinge 8. Each hinge part 81, 82 having an opening for receiving a pin (not shown).

The first and second parts of the ornament 1 may be individually integrally molded, i.e. made from a single mold. The ornament 1 preferably has a spherical shape. The ornament 1 may also have a cylindrical shape.

Figure 4A:
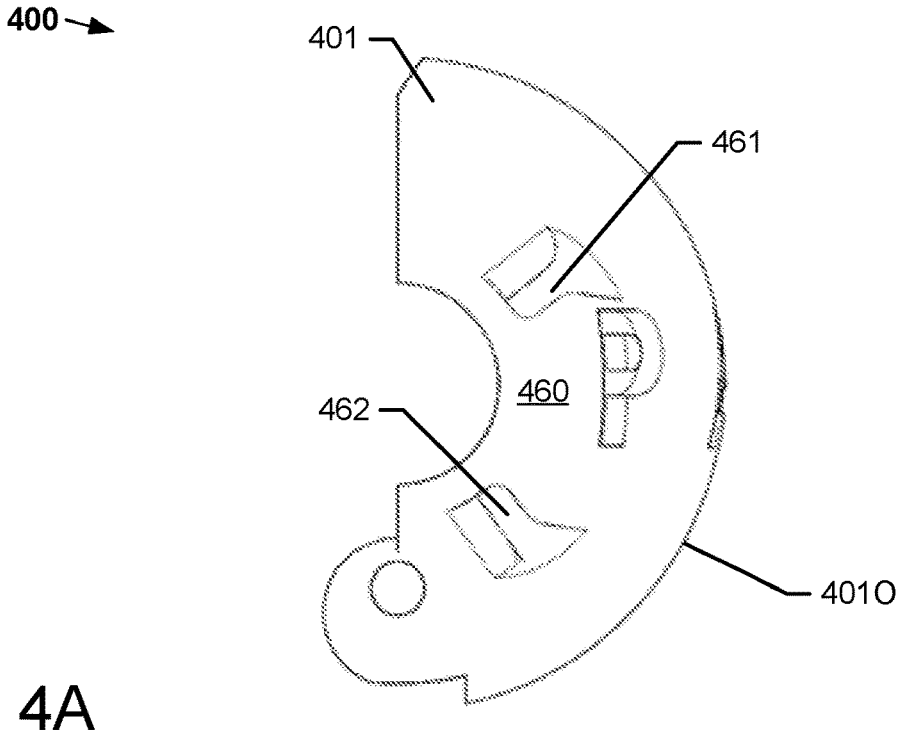
FIGS. 4A-B show a part of a shell of the ornament of FIGS. 2A-B.
Figure 4B:
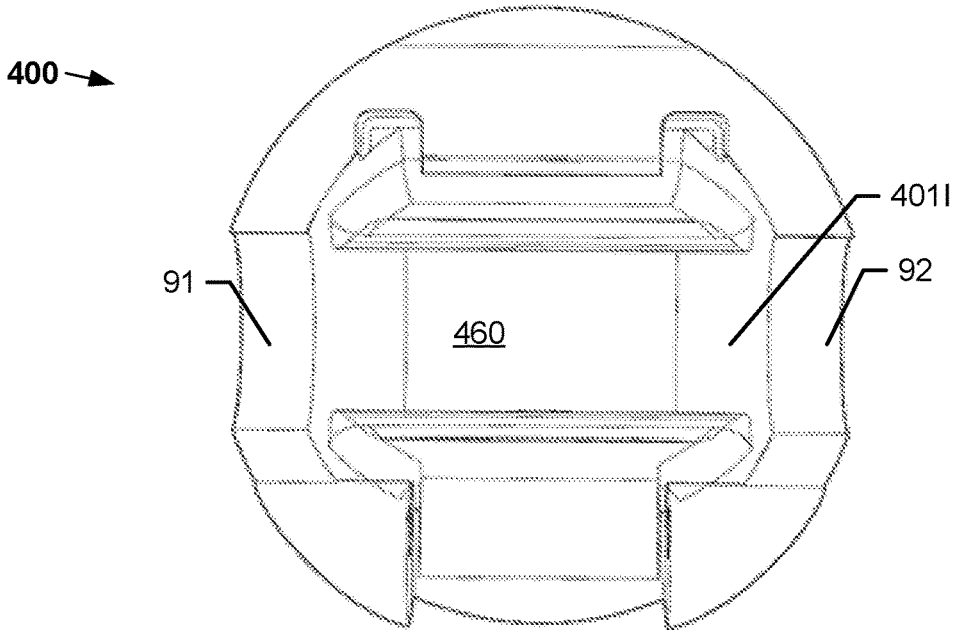
Figure 5A:
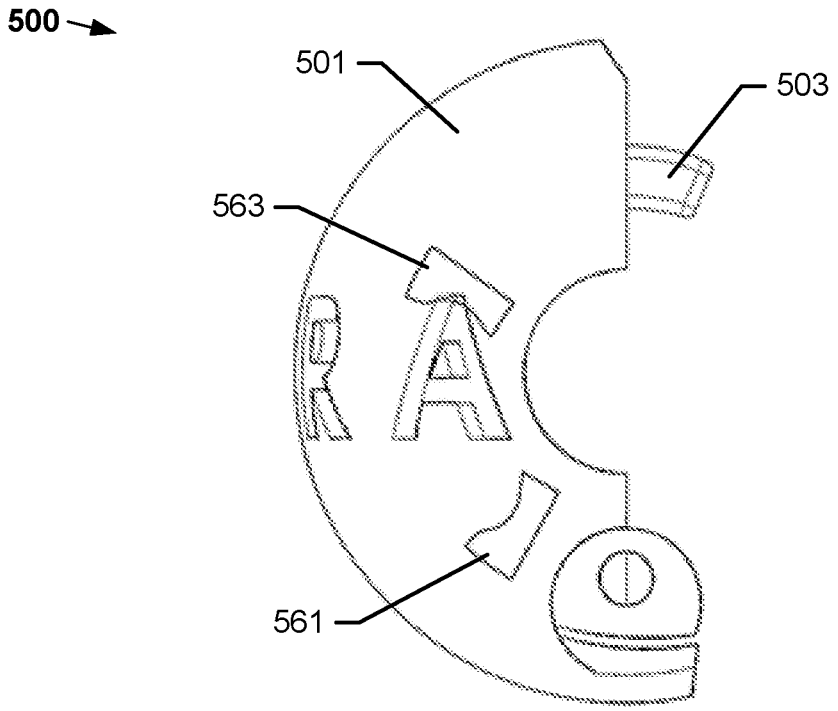
FIGS. 5A-B show another part of the shell than shown in FIGS. 4A-B.
Figure 5B:
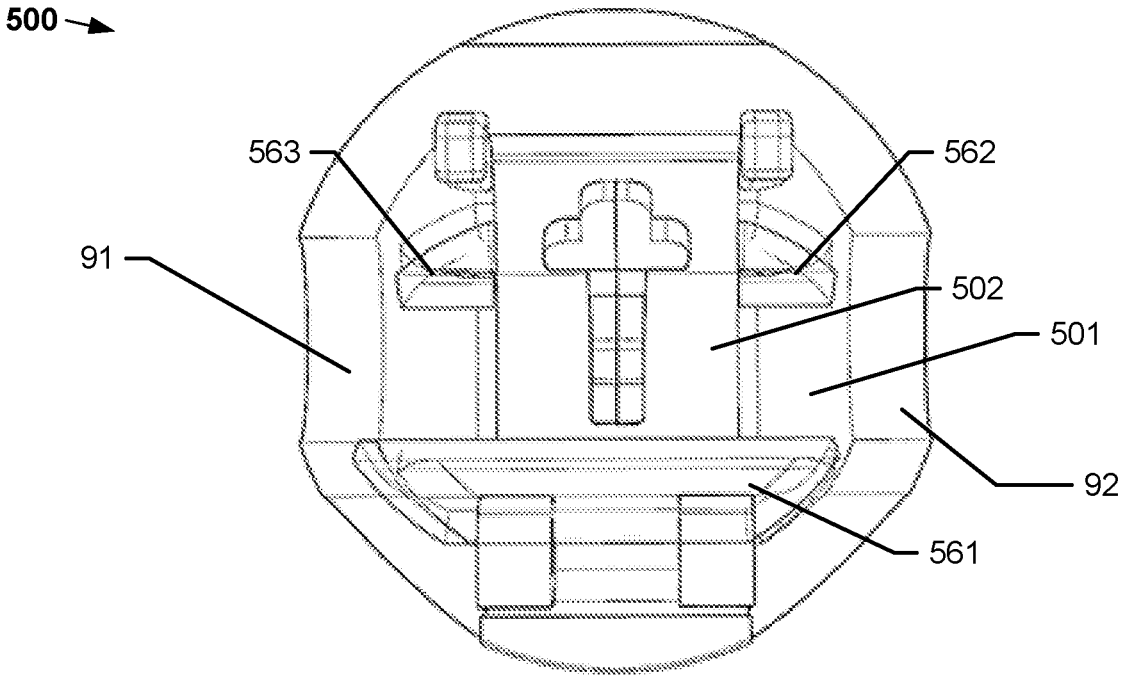

In the following the ornament 1 is described in relation to FIGS. 4A-7B. FIGS. 4A-B show the first shell part 401, and FIGS. 5A-C show the second shell part 501 of the ornament. FIGS. 6A-B show an embodiment of the locking element 560 gripping the second friction element 200 when the ornament is in the assembled configuration.

The second shell 501 of the ornament 1 comprises a closing element 502 for releasably securing the first and second parts 400; 500 of the ornament 1 to each other in a closed state of the ornament 1. The closing element 502 is arranged inside the ornament 1, so that the ornament 1 encloses the closing element 502 in the closed state. The closing element 502 is a leaf spring attached to the inside of the shell 501.

An extending part 503 of the leaf spring 502 extends out from the shell 501 and extends in the closed state of the ornament 1 into the first part 400, where it abuts a part of the shell part 401 of the first part 400. The first shell 401 comprises a closing cavity 402 for receiving the extending part 503 of the leaf spring 502 (as seen on FIGS. 7A and 7B). The closing cavity 402 comprises a closing protrusion 403. The closing protrusion 403 provides a releasable snap-lock with the extending part 503 of the spring 502. The second friction element 200 is arranged on top of the closing element 502 and at least partly secures the closing element 502 to the shell 501 of the second part 500.

As illustrated in FIGS. 6A-B, the locking element 560 is in the form of a flange 561, extending along the through hole axis A and being configured to grip the second friction element 200 and secure it to the shell. The locking element 560 further comprises two supporting flanges 562, 563 arranged opposite the flange 561, the supporting flanges 562, 563 being configured to grip the side of the second friction element 200 opposite from the side which is gripped by the flange 561, so as to assist in securing the second friction element 200 to the shell part 501. The flange 561 and the supporting flanges 562, 563 have concave shapes so as to be able to accommodate and grip the first and second wings 201, 202 of the second friction element 200.

As illustrated in FIGS. 4A-B, the shell 401 has an outer surface 4010 and an inner surface 4011. The shell part 401 comprises two side walls 461, 462 extending from the inner surface of the shell part 401. The two side walls 461, 462 are configured to grip the first friction element 100 and assist in securing the first friction element 100 in the cavity 460, so that the first friction element 100 is prevented from being detached from the shell during the sliding movement.

As seen in FIG. 7A, the volume of the part of the first friction element 100, which part is inserted into the cavity 460, is smaller than the volume of the cavity 460, so that when the ornament 1 is in the assembled configuration, the first friction element 100 does not occupy all of the available space of the cavity 460. Hereby, a free expansion space 463 is formed between a bottom of the friction element 100 and a bottom of the cavity 460, at least when the friction element 100 is in an un-compressed state, thereby allowing the friction element 100 to expand further into the cavity 460 (i.e. into the free expansion space) in response to a force exerted by the elongated member 300 on the friction element 100, when the ornament 1 is strung on the elongated member 300.

The first friction element 100 and the second friction element 200 may be manufactured from a material substantially consisting of silicone. The first friction element 100 may be manufactured by separately manufacturing the first friction part 120 and the first retaining part 110 and subsequently attaching them to each other. The second friction element 200 may also be manufactured by separately manufacturing the second friction part 220 and the second retaining part 210 and subsequently attaching them to each other. The subsequent attachment may be done by vulcanization in a contact area of the respective friction element 100, 200.

FIGS. 8A-E show assembly of the ornament 1 of an embodiment of the fourth aspect of the disclosure. Each friction element 100, 200 is assembled with its respective shell part 401, 501 in similar ways. With respect to the first friction element 100, the first wing 101 is first inserted into the cavity 460. Subsequently, a force is applied to the first friction element 100, so that the second wing 102 and thereby the first retaining part 110 of the first friction element 100 are snapped into the cavity 460. The entire first retaining part 110 is thereby arranged in the cavity 460. During this, the second hardness shore A of the first retaining part 110 acts to prevent the first friction element 100 from being detached from the shell during the described sliding movement of the ornament 1.

With respect to the second friction element 200, the first wing 201 is inserted between the flange 561 and the supporting flanges 562, 563. Subsequently, a force is applied to the second friction element 200 (in the direction of the arrows in FIG. 8A), so that the second wing 202 and thereby the second retaining part 210 of the second friction element 200 are snapped between the flange 561 and the supporting flanges 562, 563. During this, the second hardness shore A of the second retaining part 210 acts to prevent the second friction element 200 from being detached from the shell during the described sliding movement of the ornament 1.

Figure 8A:
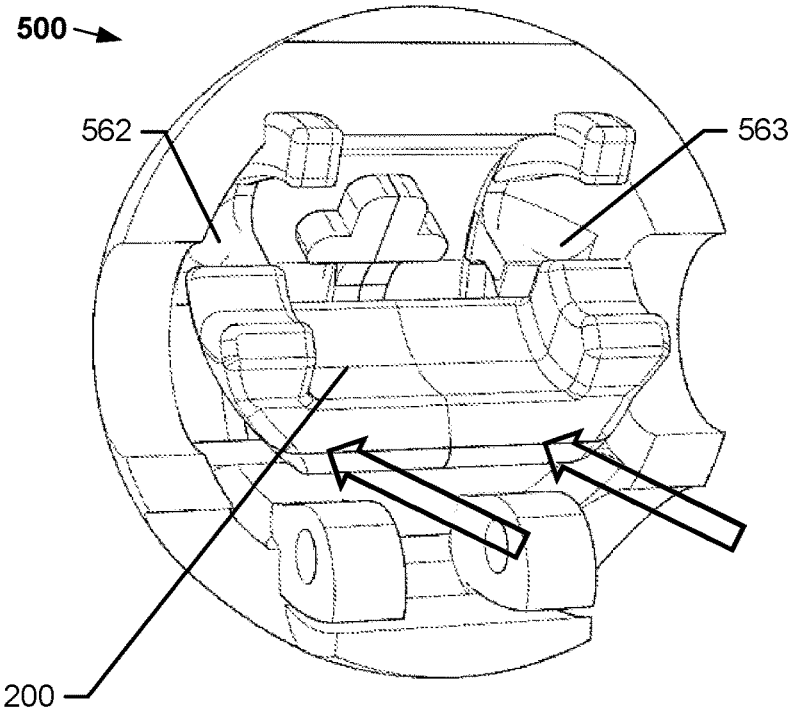
FIGS. 8A-E show a method of assembly of the ornament of FIGS. 2A-B of a fourth aspect of the disclosure.
Figure 8B:
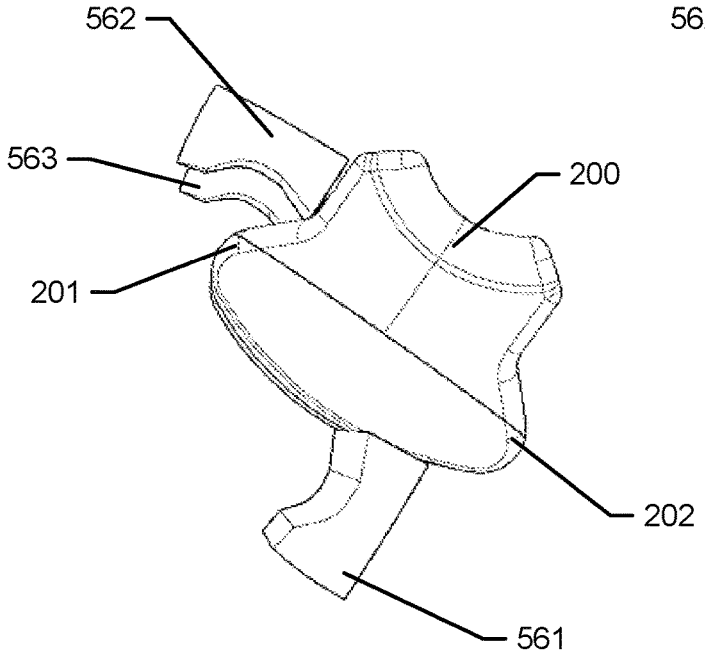
Figure 8C:
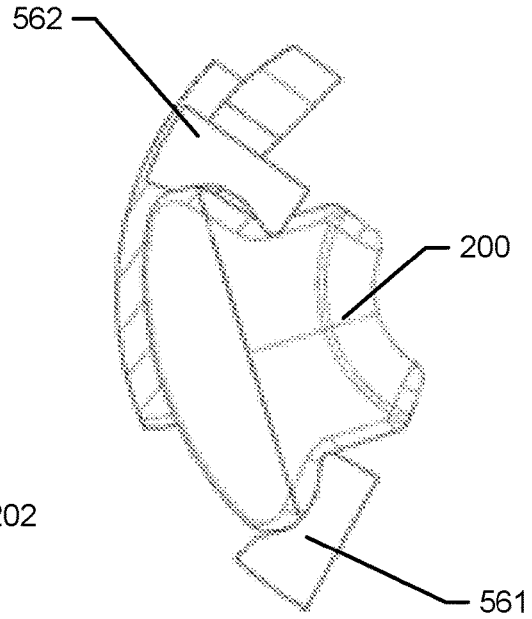
Figure 8D:
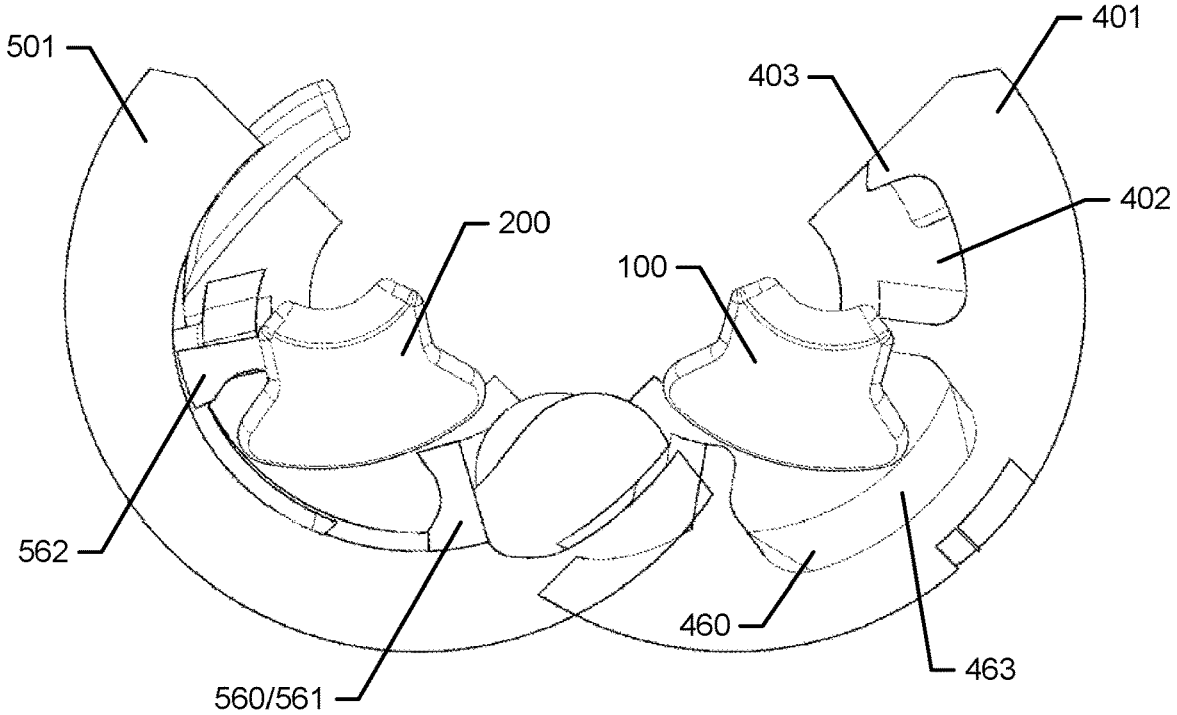
Figure 8E:
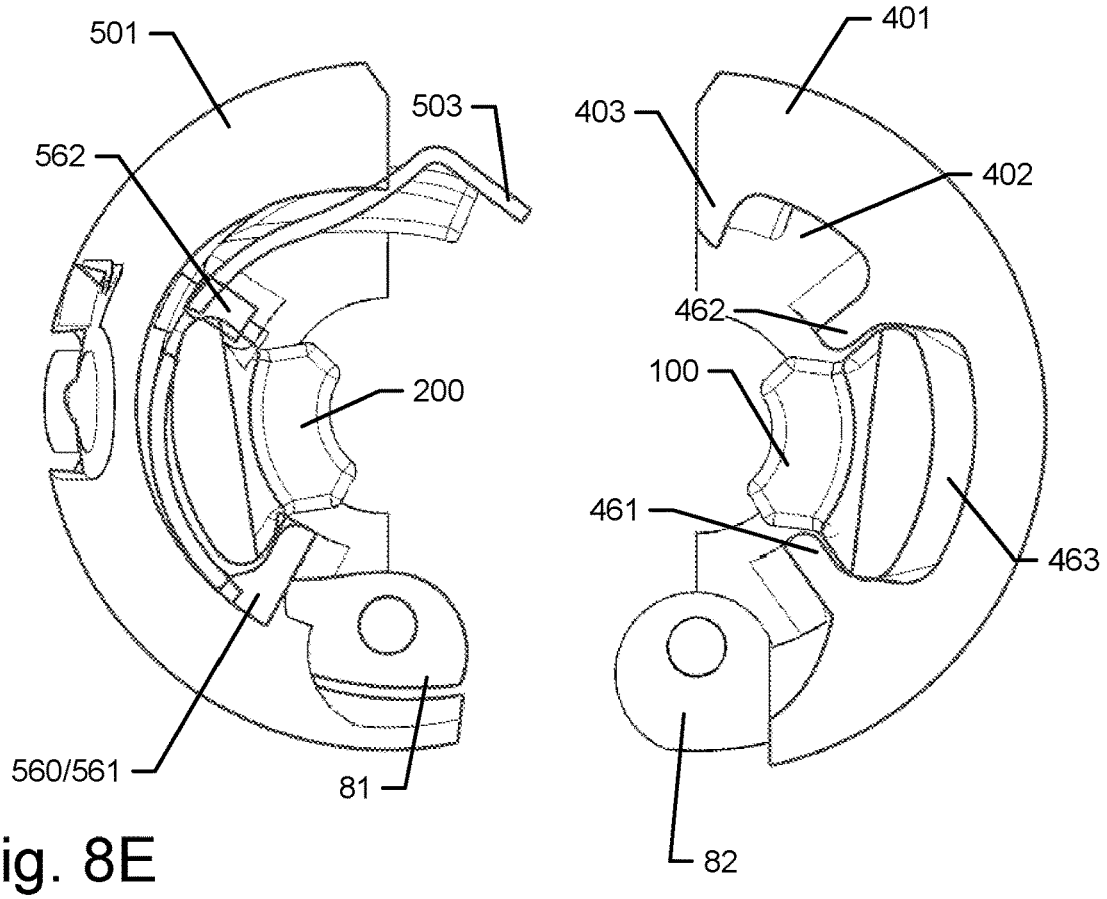

In FIG. 8D, the first and second friction elements 100, 200 are shown prior to application of the force. When the force is applied to the respective friction element 100, 200, the element 100, 200 will snap into position in the cavity 460 with regards to the first friction element 100, or in between the flanges 561, 562 with regards to the second friction element 200. In FIG. 8D, the first and second friction elements 100, 200 are shown after the force has been applied and the friction elements are snapped into position.

Figure 9:
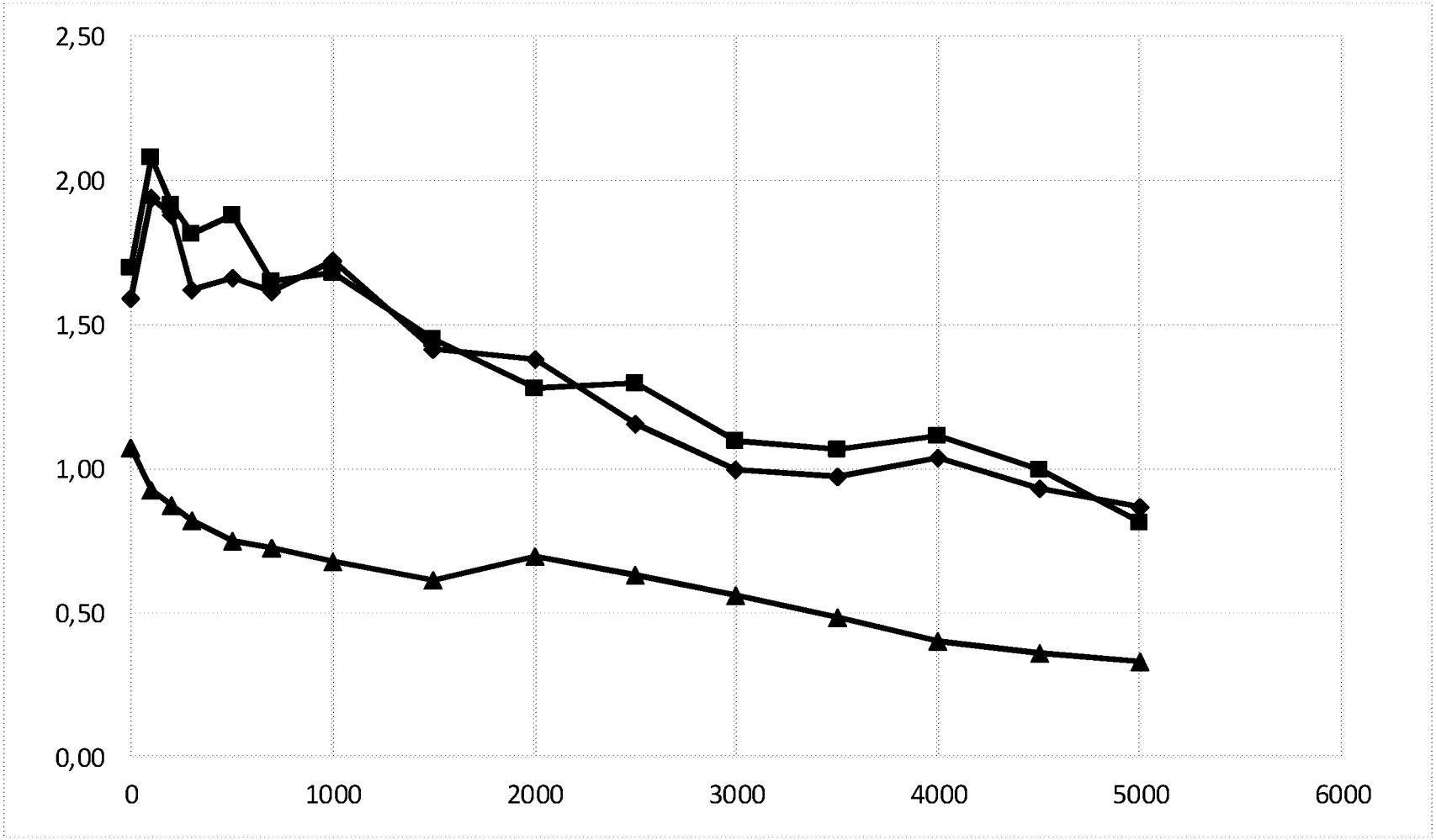
FIG. 9 shows a graph illustrating an adhesive force test of a friction element.

FIG. 9 shows a graph illustrating an adhesive force test of a friction element similar to either one of the first or second friction elements 100, 200 described above (i.e. of different hardnesses shore A), compared with a prior art friction element having one hardness. The test is used as a performance test illustrating the friction elements of the disclosure performs as desired, the friction elements maintaining the desired friction and do not fall out of the ornament. The x-axis shows the number of cycles completed and the y-axis shows the adhesive force (N). A cycle is an ornament with a friction element being moves from one position on an elongated member to another, different position on the elongated member by a sliding movement.

The points illustrated with ♦ show the test results for a friction element as described above in relation to the previous figures, where the friction part is of a material of a hardness shore A of 30, and the retaining part is of a material of a hardness shore A of 60. The points illustrated with ■ show the test results for the friction of the above described embodiment, where the friction part is of a material with a hardness shore A of 30 and the retaining part is of a material with a hardness shore A of 80. The points illustrated with ▲ show the test results for a friction element consisting of a material of only one hardness shore A. Turning to the end point for all three test, the results after 5000 cycles are; ♦=0.87 N, ■=0.82 N and ▲=0.33 N. The two friction elements of the above described embodiment performed in terms of the frictional force 263% and 248%, respectively, better than the friction element of only one hardness after 5000 cycles.

Several tests were performed with different material compositions and shapes. These showed that the prior art friction elements fell out after too few slides, yielding an unsatisfactory result. On the other hand, the friction elements of the disclosure did not fall out during the performance tests.

FIG. 10 shows schematically an embodiment of jewelry system of the second aspect of the disclosure in the form of the bracelet 800. The bracelet 800 can be assembled to form an assembled bracelet as shown. The bracelet 800 comprises the elongated member 300, and the ornament 1 as described above.

When the ornament 1 has been strung on the elongated member 300, the ornament 1 can be releasably secured in a first location 310 on the elongated member 300 and be relocated by a sliding movement along the elongated member 300 (indicated by the arrow) to be releasably secured at a second location 320. The bracelet may also comprise a further, identical ornament, also designated 1.

The bracelet 800 may further comprise a freely moveable ornament 2 strung on the elongated member 300. The bracelet could also comprise one or more further similar freely moveable ornament strung on the elongated member 300. The freely moveable ornament is an ordinary bead or charm with no friction element.

The bracelet 800 further comprises two bands 301 fixed to the elongated member 300. The bands 301 have an extended width in a radial direction of the elongated member 300 compared to a similar width of remaining parts of the elongated member 300. The ornaments 1 are configured so that the first and second gripping surfaces may grip the respective bands 301 to allow the ornaments 1 to be releasably attached to the band 301.

The elongated member 300 comprises two ends and a closing mechanism in the form of a conventional jewelry lock 390, e.g. of the hook-and-loop type, the lock 390 being adapted to connect the ends of the elongated member 300, so that the elongated member 300 and the lock 390 form a closed loop as shown.

Although some embodiments have been described and shown in detail, the present disclosure is not restricted to them, but may also be embodied in other ways. It is to be understood that other embodiments may be utilised and structural and functional modifications may be made without departing from the scope of the present disclosure.

In device claims enumerating several means, several of these means can be embodied by one and the same item of hardware. The mere fact that certain measures are recited in mutually different dependent claims or described in different embodiments does not indicate that a combination of these measures cannot be used to advantage.

It should be emphasized that the term "comprises/comprising" when used in this specification is taken to specify the presence of stated features, integers, steps, or components but does not preclude the presence or addition of one or more other features, integers, steps, components, or groups thereof.

The invention claimed is:

1. A jewelry ornament having an unassembled configuration and an assembled configuration, the jewelry ornament comprising:

a shell having a cavity; in the assembled configuration the shell having a first side with a first opening, a second side with a second opening, and a through hole that defines an open passageway extending from the first opening, through the shell, and to the second opening; and a first friction element, the first friction element being unattached to the shell in the unassembled configuration, the first friction element being at least partly located in the cavity so as to be attached to the shell in the assembled configuration;

wherein the first friction element comprises:

a first retaining part, the first retaining part being at least partly located in the cavity in the assembled configuration; and a first friction part attached to the first retaining part and comprising a gripping surface for frictionally gripping a surface of an elongated member of a bracelet or necklace when the ornament is in the assembled configuration and strung on the elongated member, whereby the ornament, when the ornament is in the assembled configuration and strung on the elongated member, can be releasably secured in a first location on the elongated member and be relocated by a sliding movement along the elongated member to be releasably secured at a second location;

wherein, in the unassembled configuration with the first friction part being at an undeformed state and the first retaining part being at an undeformed state, the first retaining part has a shore A hardness that is greater than a shore A hardness of the first friction part; and wherein the shell has an outer surface and an inner surface and further comprises two side walls extending from the inner surface of the shell, the two side walls being configured to grip the first friction element and assist in securing the first friction element in the cavity, so that the first friction element is prevented from being detached from the shell during the sliding movement.

2. The ornament of claim 1, wherein the gripping surface is a protrusion gripping surface.

3. The ornament of claim 1, wherein the first friction element is a material comprising at least 90% silicone.

4. The ornament of claim 1, wherein the ornament further comprises a second friction element selectively attached to the shell.

5. The ornament of claim 4, wherein the second friction element comprises a second retaining part gripped by a locking element when the ornament is in the assembled configuration.

6. The ornament of claim 5, wherein the second friction element comprises a second friction part attached to the second retaining part and comprising a second gripping surface for frictionally gripping a surface of the elongated member when the ornament is in the assembled configuration and strung on the elongated member.

7. The ornament of claim 1, wherein the first friction part comprises a first material and the first retaining part comprises a second material different from the first material.

8. The ornament of claim 7, wherein the shore A hardness of the second material is in a range of 70-90 shore A.

9. The ornament of claim 1, wherein the shore A hardness of the first retaining part is at least 200 percent of the shore A hardness of the first friction part.

10. The ornament of claim 1, wherein the shore A hardness of the first friction part is in a range of 20-40 shore A.

11. The ornament of claim 1, wherein the first friction part comprises a first protrusion extending away from the first retaining part and having a first protrusion gripping surface for frictionally gripping a first surface area of the elongated member when the ornament is in the assembled configuration and strung on the elongated member.

12. The ornament of claim 11, wherein the first protrusion and the first friction part are formed as one piece.

13. The ornament of claim 11, wherein the first friction part further comprises a second protrusion arranged at a distance from the first protrusion, the second protrusion extending away from the first retaining part and having a second protrusion gripping surface for frictionally gripping a second surface area of the elongated member when the ornament is in the assembled configuration and strung on the elongated member; the second surface area being different from, and arranged at a distance to, the first surface area so that the ornament may be releasably secured to parts of the elongated member having different diameters.

14. A jewelry system, comprising:

an elongated member; and a jewelry ornament having an unassembled configuration and an assembled configuration;

wherein the jewelry ornament comprises:

a shell having a cavity; in the assembled configuration the shell having a first side with a first opening, a second side with a second opening, and a through hole that defines an open passageway extending from the first opening, through the shell, and to the second opening; and a first friction element, the first friction element being unattached to the shell in the unassembled configuration, the first friction element being at least partly located in the cavity so as to be attached to the shell in the assembled configuration;

wherein the first friction element comprises:

a first retaining part, the first retaining part being at least partly located in the cavity in the assembled configuration; and a first friction part attached to the first retaining part and comprising a gripping surface for frictionally gripping a surface of the elongated member when the ornament is in the assembled configuration and strung on the elongated member, whereby the ornament, when the ornament is in the assembled configuration and strung on the elongated member, can be releasably secured in a first location on the elongated member and be relocated by a sliding movement along the elongated member to be releasably secured at a second location;

wherein, in the unassembled configuration with the first friction part being at an undeformed state and the first retaining part being at an undeformed state, the first retaining part has a shore A hardness that is greater than a shore A hardness of the first friction part; and wherein the shell has an outer surface and an inner surface and further comprises two side walls extending from the inner surface of the shell, the two side walls being configured to grip the first friction element and assist in securing the first friction element in the cavity, so that the first friction element is prevented from being detached from the shell during the sliding movement.

15. The jewelry system of claim 14, wherein the elongated member further comprises two ends and a lock, the lock being configured to connect the ends of the elongated member so that the elongated member and the lock form a closed loop.

16. The jewelry system of claim 14, wherein when the ornament is in the assembled configuration and strung on the elongated member, the first friction part is continuously in contact with the elongated member before, during and after the sliding movement.

17. The jewelry system of claim 14, wherein the piece of jewelry is a bracelet or a necklace.

* * * * *